US010544631B2

(12) United States Patent
Reinecke

(10) Patent No.: US 10,544,631 B2
(45) Date of Patent: Jan. 28, 2020

(54) COMBINED MULTI-COUPLER FOR TOP DRIVE

(71) Applicant: Weatherford Technology Holdings, LLC, Houston, TX (US)

(72) Inventor: Thomas Reinecke, Hannover (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 198 days.

(21) Appl. No.: 15/627,237

(22) Filed: Jun. 19, 2017

(65) Prior Publication Data

US 2018/0363386 A1 Dec. 20, 2018

(51) Int. Cl.

| | |
|---|---|
| ***E21B 3/02*** | (2006.01) |
| ***E21B 17/02*** | (2006.01) |
| ***E21B 17/03*** | (2006.01) |
| ***E21B 17/043*** | (2006.01) |

(52) U.S. Cl.

CPC ..... *E21B 17/03* (2013.01); *E21B 17/021* (2013.01); *E21B 17/023* (2013.01); *E21B 17/043* (2013.01)

(58) Field of Classification Search

CPC ..... E21B 19/16; E21B 19/06; E21B 19/07; E21B 17/02; E21B 17/046; E21B 19/08; E21B 3/02

See application file for complete search history.

(56) References Cited

U.S. PATENT DOCUMENTS

| | | | | |
|---|---|---|---|---|
| 1,367,156 A | | 2/1921 | McAlvay et al. | |
| 1,610,977 A | | 12/1926 | Scott | |
| 1,822,444 A | | 9/1931 | MacClatchie | |
| 2,370,354 A | | 2/1945 | Hurst | |
| 2,683,379 A | | 7/1954 | Strandgren | |
| 2,863,638 A | * | 12/1958 | Thornburg | E21B 3/02 173/197 |
| 3,147,992 A | | 9/1964 | Haeber et al. | |
| 3,354,951 A | | 11/1967 | Savage et al. | |
| 3,385,370 A | | 5/1968 | Knox et al. | |
| 3,662,842 A | | 5/1972 | Bromell | |

(Continued)

FOREIGN PATENT DOCUMENTS

| | | |
|---|---|---|
| AU | 2012201644 A1 | 4/2012 |
| AU | 2013205714 A1 | 5/2013 |

(Continued)

OTHER PUBLICATIONS

European Patent Office; Extended Search Report for Application No. 18160808.4; dated Sep. 20, 2018; 8 total pages.

(Continued)

*Primary Examiner* — Kipp C Wallace

(74) *Attorney, Agent, or Firm* — Patterson + Sheridan, LLP

(57) ABSTRACT

In one embodiment, a coupling system for a top drive and a tool includes a housing of the top drive having a bore therethrough, an adapter of the tool, a latch member at least partially disposed within the housing and radially movable between an extended position and a retracted position, wherein the latch member is configured to longitudinally couple the housing to the adapter, and a lock member at least partially disposed within the housing and longitudinally movable relative to the housing, wherein the lock member is configured to move the latch member between the extended and the retracted positions.

25 Claims, 11 Drawing Sheets

(56) References Cited

U.S. PATENT DOCUMENTS 3,698,426 A 10/1972 Litchfield et al.
3,747,675 A 7/1973 Brown
3,766,991 A 10/1973 Brown
3,774,697 A 11/1973 Brown
3,776,320 A 12/1973 Brown
3,808,916 A * 5/1974 Porter ..... E21B 3/02 175/320
3,842,619 A 10/1974 Bychurch, Sr.
3,888,318 A 6/1975 Brown
3,899,024 A 8/1975 Tonnelli et al.
3,913,687 A 10/1975 Gyongyosi et al.
3,915,244 A 10/1975 Brown
3,917,092 A 11/1975 McGinnis
3,964,552 A 6/1976 Slator
4,022,284 A 5/1977 Crow
4,051,587 A 10/1977 Boyadjieff
4,100,968 A 7/1978 Delano
4,192,155 A 3/1980 Gray
4,199,847 A 4/1980 Owens
4,235,469 A 11/1980 Denny et al.
4,364,407 A 12/1982 Hilliard
4,377,179 A 3/1983 Giebeler
4,402,239 A 9/1983 Mooney
4,422,794 A * 12/1983 Deken ..... E21B 17/046 292/128
4,449,596 A 5/1984 Boyadjieff
4,478,244 A 10/1984 Garrett
4,497,224 A 2/1985 Jürgens
4,593,773 A 6/1986 Skeie
4,647,050 A 3/1987 Johnson
4,762,187 A 8/1988 Haney
4,776,617 A 10/1988 Sato
4,779,688 A 10/1988 Baugh
4,791,997 A 12/1988 Krasnov
4,813,493 A 3/1989 Shaw et al.
4,815,546 A 3/1989 Haney et al.
4,821,814 A 4/1989 Willis et al.
4,844,181 A 7/1989 Bassinger
4,867,236 A 9/1989 Haney et al.
4,916,959 A 4/1990 Lively
4,932,253 A 6/1990 McCoy
4,955,949 A 9/1990 Bailey et al.
4,962,819 A 10/1990 Bailey et al.
4,972,741 A 11/1990 Sibille
4,981,180 A 1/1991 Price
4,997,042 A 3/1991 Jordan et al.
5,018,350 A 5/1991 Bender
5,020,640 A 6/1991 Nederbragt
5,036,927 A 8/1991 Willis
5,099,725 A 3/1992 Bouligny, Jr. et al.
5,152,554 A 10/1992 LaFleur et al.
5,172,940 A 12/1992 Usui et al.
5,191,939 A 3/1993 Stokley
5,196,770 A 3/1993 Champs et al.
5,215,153 A 6/1993 Younes
5,245,877 A 9/1993 Ruark
5,282,653 A 2/1994 LaFleur et al.
5,297,833 A 3/1994 Willis et al.
5,348,351 A 9/1994 LaFleur et al.
5,385,514 A 1/1995 Dawe
5,404,767 A 4/1995 Sutherland
5,433,279 A 7/1995 Tessari et al.
5,440,183 A 8/1995 Denne
5,441,310 A 8/1995 Barrett et al.
5,456,320 A 10/1995 Baker
5,479,988 A 1/1996 Appleton
5,486,223 A 1/1996 Carden
5,501,280 A 3/1996 Brisco
5,509,442 A 4/1996 Claycomb
5,540,095 A 7/1996 Sherman et al.
5,577,566 A 11/1996 Albright et al.
5,584,343 A 12/1996 Coone
5,645,131 A 7/1997 Trevisani
5,664,310 A 9/1997 Penisson
5,682,952 A 11/1997 Stokley
5,735,348 A 4/1998 Hawkins, III
5,778,742 A 7/1998 Stuart
5,839,330 A 11/1998 Stokka
5,909,768 A 6/1999 Castille et al.
5,918,673 A 7/1999 Hawkins et al.
5,950,724 A 9/1999 Giebeler
5,971,079 A 10/1999 Mullins
5,992,520 A 11/1999 Schultz et al.
6,003,412 A 12/1999 Dlask et al.
6,011,508 A 1/2000 Perreault et al.
6,053,191 A 4/2000 Hussey
6,101,952 A 8/2000 Thornton et al.
6,102,116 A 8/2000 Giovanni
6,142,545 A 11/2000 Penman et al.
6,161,617 A 12/2000 Gjedebo
6,173,777 B1 1/2001 Mullins
6,276,450 B1 8/2001 Seneviratne
6,279,654 B1 8/2001 Mosing et al.
6,289,911 B1 9/2001 Majkovic
6,309,002 B1 10/2001 Bouligny
6,311,792 B1 11/2001 Scott et al.
6,328,343 B1 12/2001 Hosie et al.
6,378,630 B1 4/2002 Ritorto et al.
6,390,190 B2 5/2002 Mullins
6,401,811 B1 6/2002 Coone
6,415,862 B1 7/2002 Mullins
6,431,626 B1 8/2002 Bouligny
6,443,241 B1 9/2002 Juhasz et al.
6,460,620 B1 10/2002 LaFleur
6,499,701 B1 12/2002 Thornton et al.
6,508,132 B1 1/2003 Lohr et al.
6,527,047 B1 3/2003 Pietras
6,536,520 B1 3/2003 Snider et al.
6,571,876 B2 6/2003 Szarka
6,578,495 B1 6/2003 Yitts et al.
6,578,632 B2 6/2003 Mullins
6,595,288 B2 7/2003 Mosing et al.
6,604,578 B2 8/2003 Mullins
6,606,569 B1 8/2003 Potts
6,622,796 B1 9/2003 Pietras
6,637,526 B2 10/2003 Juhasz et al.
6,640,824 B2 11/2003 Majkovic
6,666,273 B2 12/2003 Laurel
6,675,889 B1 1/2004 Mullins et al.
6,679,333 B2 1/2004 York et al.
6,688,398 B2 2/2004 Pietras
6,691,801 B2 2/2004 Juhasz et al.
6,705,405 B1 3/2004 Pietras
6,715,542 B2 4/2004 Mullins
6,719,046 B2 4/2004 Mullins
6,722,425 B2 4/2004 Mullins et al.
6,725,938 B1 4/2004 Pietras
6,732,819 B2 5/2004 Wenzel
6,732,822 B2 * 5/2004 Slack ..... B25B 5/065 166/138
6,742,584 B1 6/2004 Appleton
6,742,596 B2 6/2004 Haugen
6,770,004 B1 8/2004 Lofgren et al.
6,779,599 B2 8/2004 Mullins et al.
6,832,656 B2 12/2004 Fournier, Jr. et al.
6,851,476 B2 2/2005 Gray et al.
6,883,605 B2 4/2005 Arceneaux et al.
6,892,835 B2 5/2005 Shahin et al.
6,908,121 B2 6/2005 Hirth et al.
6,925,807 B2 8/2005 Jones et al.
6,938,697 B2 9/2005 Haugen
6,976,298 B1 12/2005 Pietras
6,983,701 B2 1/2006 Thornton et al.
6,994,176 B2 2/2006 Shahin et al.
7,000,503 B2 2/2006 Dagenais et al.
7,001,065 B2 2/2006 Dishaw et al.
7,004,259 B2 2/2006 Pietras
7,007,753 B2 3/2006 Robichaux et al.
7,017,671 B2 3/2006 Williford
7,021,374 B2 4/2006 Pietras
7,025,130 B2 4/2006 Bailey et al.
7,073,598 B2 7/2006 Haugen
7,090,021 B2 8/2006 Pietras
7,096,948 B2 8/2006 Mosing et al.

(56) References Cited

U.S. PATENT DOCUMENTS 7,114,235 B2 10/2006 Jansch et al.
7,128,161 B2 10/2006 Pietras
7,137,454 B2 11/2006 Pietras
7,140,443 B2 11/2006 Beierbach et al.
7,143,849 B2 12/2006 Shahin et al.
7,147,254 B2 12/2006 Niven et al.
7,159,654 B2 1/2007 Ellison et al.
7,178,600 B2 2/2007 Luke et al.
7,178,612 B2 2/2007 Belik
7,213,656 B2 5/2007 Pietras
7,219,744 B2 5/2007 Pietras
7,231,969 B2 6/2007 Folk et al.
7,270,189 B2 9/2007 Brown et al.
7,281,451 B2 10/2007 Schulze Beckinghausen
7,281,587 B2 10/2007 Haugen
7,290,476 B1 11/2007 Glasson
7,303,022 B2 12/2007 Tilton et al.
7,325,610 B2 2/2008 Giroux et al.
7,353,880 B2 4/2008 Pietras
7,373,971 B2 5/2008 Montgomery
7,448,456 B2 11/2008 Shahin et al.
7,451,826 B2 11/2008 Pietras
7,490,677 B2 2/2009 Buytaert et al.
7,503,397 B2 3/2009 Giroux et al.
7,509,722 B2 3/2009 Shahin et al.
7,513,300 B2 4/2009 Pietras et al.
7,530,799 B2 5/2009 Smith
7,579,941 B2 8/2009 Cleveland et al.
7,591,304 B2 9/2009 Juhasz et al.
7,617,866 B2 11/2009 Pietras
7,635,026 B2 12/2009 Mosing et al.
7,665,515 B2 2/2010 Mullins
7,665,530 B2 2/2010 Wells et al.
7,665,531 B2 2/2010 Pietras
7,669,662 B2 3/2010 Pietras
7,690,422 B2 4/2010 Swietlik et al.
7,694,730 B2 4/2010 Angman
7,694,744 B2 4/2010 Shahin
7,699,121 B2 4/2010 Juhasz et al.
7,712,523 B2 5/2010 Snider et al.
7,730,698 B1 6/2010 Montano et al.
7,757,759 B2 7/2010 Jahn et al.
7,779,922 B1 8/2010 Harris et al.
7,793,719 B2 9/2010 Snider et al.
7,817,062 B1 10/2010 Li et al.
7,828,085 B2 11/2010 Kuttel et al.
7,841,415 B2 11/2010 Winter
7,854,265 B2 12/2010 Zimmermann
7,857,043 B2 12/2010 Ali-zada
7,866,390 B2 1/2011 Latiolais, Jr. et al.
7,874,352 B2 1/2011 Odell, II et al.
7,874,361 B2 1/2011 Mosing et al.
7,878,237 B2 2/2011 Angman
7,878,254 B2 2/2011 Abdollahi et al.
7,882,902 B2 2/2011 Boutwell, Jr.
7,896,084 B2 3/2011 Haugen
7,918,273 B2 4/2011 Snider et al.
7,958,787 B2 6/2011 Hunter
7,971,637 B2 7/2011 Duhon et al.
7,975,768 B2 7/2011 Fraser et al.
8,036,829 B2 10/2011 Gibbs et al.
8,118,106 B2 2/2012 Wiens et al.
8,141,642 B2 3/2012 Olstad et al.
8,210,268 B2 7/2012 Heidecke et al.
8,256,579 B2 9/2012 Jia
8,281,856 B2 10/2012 Jahn et al.
8,307,903 B2 11/2012 Redlinger et al.
8,328,527 B2 12/2012 Ehimeakhe
8,365,834 B2 2/2013 Liess et al.
8,459,361 B2 6/2013 Leuchtenberg
8,505,984 B2 8/2013 Henderson et al.
8,567,512 B2 10/2013 Odell, II et al.
8,601,910 B2 12/2013 Begnaud
8,616,134 B2 12/2013 King et al.
8,624,699 B2 1/2014 Hunter et al.
8,636,067 B2 1/2014 Robichaux et al.
8,651,175 B2 2/2014 Fallen
8,668,003 B2 3/2014 Osmundsen et al.
8,708,055 B2 4/2014 Liess et al.
8,727,021 B2 5/2014 Heidecke et al.
8,776,898 B2 7/2014 Liess et al.
8,783,339 B2 7/2014 Sinclair et al.
8,839,884 B2 9/2014 Kuttel et al.
8,849,954 B2 9/2014 Kim
8,851,860 B1 10/2014 Mail
8,858,187 B2 10/2014 Lane
8,893,772 B2 11/2014 Henderson et al.
9,068,406 B2 6/2015 Clasen et al.
9,206,851 B2 12/2015 Slaughter, Jr. et al.
9,359,835 B2 * 6/2016 Leman ..... E21B 19/00
9,528,326 B2 12/2016 Heidecke et al.
9,631,438 B2 4/2017 McKay
9,772,608 B2 * 9/2017 Spacek ..... E21B 17/003
2002/0043403 A1 4/2002 Juhasz et al.
2002/0074132 A1 6/2002 Juhasz et al.
2002/0084069 A1 7/2002 Mosing et al.
2002/0129934 A1 9/2002 Mullins et al.
2002/0170720 A1 11/2002 Haugen
2003/0098150 A1 5/2003 Andreychuk
2003/0107260 A1 6/2003 Ording et al.
2003/0221519 A1 12/2003 Haugen
2004/0003490 A1 1/2004 Shahin et al.
2004/0069497 A1 4/2004 Jones et al.
2004/0163822 A1 8/2004 Zhang et al.
2004/0216924 A1 * 11/2004 Pietras ..... E21B 19/00
175/57
2004/0222901 A1 11/2004 Dodge et al.
2005/0000691 A1 1/2005 Giroux et al.
2005/0087368 A1 4/2005 Boyle et al.
2005/0173154 A1 8/2005 Lesko
2005/0206163 A1 9/2005 Guesnon et al.
2005/0257933 A1 11/2005 Pietras
2005/0269072 A1 12/2005 Folk et al.
2005/0269104 A1 12/2005 Folk et al.
2005/0269105 A1 12/2005 Pietras
2005/0274508 A1 12/2005 Folk et al.
2006/0001549 A1 1/2006 Shah et al.
2006/0037784 A1 2/2006 Walter et al.
2006/0124353 A1 6/2006 Juhasz et al.
2006/0151181 A1 7/2006 Shahin
2006/0180315 A1 8/2006 Shahin et al.
2006/0290528 A1 12/2006 MacPherson et al.
2007/0017671 A1 1/2007 Clark et al.
2007/0029112 A1 2/2007 Li et al.
2007/0030167 A1 2/2007 Li et al.
2007/0044973 A1 3/2007 Fraser et al.
2007/0074588 A1 4/2007 Harata et al.
2007/0074874 A1 4/2007 Richardson
2007/0102992 A1 5/2007 Jager
2007/0131416 A1 6/2007 Odell, II et al.
2007/0137853 A1 6/2007 Zhang et al.
2007/0140801 A1 6/2007 Kuttel et al.
2007/0144730 A1 6/2007 Shahin et al.
2007/0158076 A1 7/2007 Hollingsworth, Jr. et al.
2007/0188344 A1 8/2007 Hache et al.
2007/0251699 A1 11/2007 Wells et al.
2007/0251701 A1 11/2007 Jahn et al.
2007/0257811 A1 11/2007 Hall et al.
2007/0263488 A1 11/2007 Clark
2008/0006401 A1 1/2008 Buytaert et al.
2008/0007421 A1 1/2008 Liu et al.
2008/0018603 A1 1/2008 Baraz et al.
2008/0059073 A1 3/2008 Giroux et al.
2008/0093127 A1 4/2008 Angman
2008/0099196 A1 5/2008 Latiolais et al.
2008/0125876 A1 5/2008 Boutwell
2008/0202812 A1 8/2008 Childers et al.
2008/0210063 A1 * 9/2008 Slack ..... E21B 19/06
81/420
2008/0308281 A1 12/2008 Boutwell, Jr. et al.
2009/0115623 A1 5/2009 Macpherson et al.
2009/0146836 A1 6/2009 Santoso et al.
2009/0151934 A1 * 6/2009 Heidecke ..... E21B 3/02
166/250.01

(56) References Cited

U.S. PATENT DOCUMENTS

2009/0159294 A1 6/2009 Abdollahi et al.
2009/0173493 A1 7/2009 Hutin et al.
2009/0200038 A1 8/2009 Swietlik et al.
2009/0205820 A1 8/2009 Koederitz et al.
2009/0205827 A1 8/2009 Swietlik et al.
2009/0205836 A1 8/2009 Swietlik et al.
2009/0205837 A1 8/2009 Swietlik et al.
2009/0229837 A1 9/2009 Wiens et al.
2009/0266532 A1 10/2009 Revheim et al.
2009/0272537 A1 11/2009 Alikin et al.
2009/0274544 A1 11/2009 Liess
2009/0274545 A1 11/2009 Liess et al.
2009/0289808 A1 11/2009 Prammer
2009/0316528 A1 12/2009 Ramshaw et al.
2009/0321086 A1 12/2009 Zimmermann
2010/0032162 A1 2/2010 Olstad et al.
2010/0097890 A1 4/2010 Sullivan et al.
2010/0101805 A1 4/2010 Angelle et al.
2010/0116550 A1 5/2010 Hutin et al.
2010/0171638 A1 7/2010 Clark
2010/0171639 A1 7/2010 Clark
2010/0172210 A1 7/2010 Clark
2010/0182161 A1 7/2010 Robbins et al.
2010/0200222 A1 8/2010 Robichaux et al.
2010/0206583 A1 8/2010 Swietlik et al.
2010/0206584 A1 8/2010 Clubb et al.
2010/0213942 A1 8/2010 Lazarev
2010/0236777 A1 9/2010 Partouche et al.
2010/0271233 A1 10/2010 Li et al.
2010/0328096 A1 12/2010 Hache et al.
2011/0017512 A1 1/2011 Codazzi
2011/0018734 A1 1/2011 Varveropoulos et al.
2011/0036563 A1* 2/2011 Brække ..... E21B 17/046 166/170
2011/0036586 A1 2/2011 Hart et al.
2011/0039086 A1 2/2011 Graham et al.
2011/0048739 A1* 3/2011 Blair ..... E21B 19/10 166/380
2011/0088495 A1 4/2011 Buck et al.
2011/0198076 A1 8/2011 Villreal et al.
2011/0214919 A1 9/2011 McClung, III
2011/0280104 A1 11/2011 McClung, III
2012/0013481 A1 1/2012 Clark
2012/0014219 A1 1/2012 Clark
2012/0020808 A1 1/2012 Lawson et al.
2012/0048574 A1* 3/2012 Wiens ..... E21B 21/00 166/387
2012/0126992 A1 5/2012 Rodney et al.
2012/0152530 A1 6/2012 Wiedecke et al.
2012/0153609 A1* 6/2012 McMiles ..... E21B 17/046 285/18
2012/0160517 A1 6/2012 Bouligny et al.
2012/0166089 A1 6/2012 Ramshaw et al.
2012/0212326 A1 8/2012 Christiansen et al.
2012/0234107 A1 9/2012 Pindiprolu et al.
2012/0274477 A1 11/2012 Prammer
2012/0298376 A1 11/2012 Twardowski
2013/0045116 A1 2/2013 Wang et al.
2013/0055858 A1 3/2013 Richardson
2013/0056977 A1 3/2013 Henderson et al.
2013/0062074 A1 3/2013 Angelle et al.
2013/0075077 A1 3/2013 Henderson et al.
2013/0075106 A1 3/2013 Tran et al.
2013/0105178 A1 5/2013 Pietras
2013/0186638 A1 7/2013 Filippov et al.
2013/0192357 A1 8/2013 Ramshaw et al.
2013/0207382 A1 8/2013 Robichaux
2013/0207388 A1 8/2013 Jansson et al.
2013/0233624 A1 9/2013 In
2013/0269926 A1 10/2013 Liess et al.
2013/0271576 A1 10/2013 Elllis
2013/0275100 A1 10/2013 Ellis et al.
2013/0278432 A1 10/2013 Shashoua et al.
2013/0299247 A1 11/2013 Kottel et al.
2014/0069720 A1 3/2014 Gray
2014/0083768 A1 3/2014 Moriarty et al.
2014/0083769 A1 3/2014 Moriarty et al.
2014/0090856 A1 4/2014 Pratt et al.
2014/0116686 A1 5/2014 Odell, II et al.
2014/0131052 A1 5/2014 Richardson
2014/0202767 A1 7/2014 Feasey
2014/0233804 A1 8/2014 Gustavsson et al.
2014/0246237 A1 9/2014 Prammer
2014/0262521 A1 9/2014 Bradley et al.
2014/0305662 A1 10/2014 Giroux et al.
2014/0312716 A1 10/2014 Hunter et al.
2014/0326468 A1 11/2014 Heidecke et al.
2014/0352944 A1 12/2014 Devarajan et al.
2014/0360780 A1 12/2014 Moss et al.
2015/0014063 A1 1/2015 Simanjuntak et al.
2015/0053424 A1 2/2015 Wiens et al.
2015/0075770 A1 3/2015 Fripp
2015/0083391 A1 3/2015 Bangert et al.
2015/0090444 A1 4/2015 Partouche et al.
2015/0107385 A1 4/2015 Mullins et al.
2015/0131410 A1 5/2015 Clark
2015/0218894 A1* 8/2015 Slack ..... E21B 19/16 166/77.51
2015/0275657 A1 10/2015 Deffenbaugh et al.
2015/0285066 A1 10/2015 Keller et al.
2015/0292319 A1 10/2015 Disko et al.
2015/0300112 A1* 10/2015 Hered ..... E21B 19/07 166/382
2015/0337648 A1 11/2015 Zippel et al.
2015/0337651 A1 11/2015 Prammer
2016/0024862 A1 1/2016 Wilson et al.
2016/0032715 A1 2/2016 Mueller et al.
2016/0053610 A1 2/2016 Switzer et al.
2016/0138348 A1 5/2016 Kunec
2016/0145954 A1 5/2016 Helms et al.
2016/0177639 A1 6/2016 McIntosh et al.
2016/0215592 A1 7/2016 Helms et al.
2016/0230481 A1 8/2016 Misson et al.
2016/0291188 A1 10/2016 Lim
2016/0326867 A1 11/2016 Prammer
2016/0333682 A1 11/2016 Griffing et al.
2017/0037683 A1 2/2017 Heidecke et al.
2017/0044854 A1 2/2017 Hebebrand et al.
2017/0044875 A1 2/2017 Hebebrand et al.
2017/0051568 A1 2/2017 Wern et al.
2017/0067303 A1 3/2017 Thiemann et al.
2017/0067320 A1 3/2017 Zouhair et al.
2017/0074075 A1* 3/2017 Liess ..... E21B 41/00
2017/0211327 A1 7/2017 Wern et al.
2017/0211343 A1 7/2017 Thiemann
2017/0234083 A1* 8/2017 Tavakoli ..... E21B 19/07 166/77.52
2017/0248009 A1 8/2017 Fripp
2017/0248012 A1 8/2017 Donderici et al.
2017/0284164 A1 10/2017 Holmes et al.
2017/0335681 A1 11/2017 Nguyen et al.
2017/0356288 A1 12/2017 Switzer et al.
2018/0087374 A1 3/2018 Robson et al.
2018/0087375 A1 3/2018 Segura Dominguez
2018/0135409 A1 5/2018 Wilson et al.
2018/0252095 A1 9/2018 Pridat et al.

FOREIGN PATENT DOCUMENTS

AU 2014215938 A1 9/2014
CA 2 707 050 A1 6/2009
CA 2707050 A1 6/2009
CA 2 841 654 A1 8/2015
CA 2841654 A1 8/2015
CA 2944327 A1 10/2015
CN 2412105 Y 12/2000
CN 201810278 U 4/2011
DE 102007016822 A1 10/2008
EP 0 250 072 A2 12/1987
EP 0 250 072 B1 4/1991
EP 1 619 349 A2 1/2006
EP 1619349 A2 1/2006
EP 1 772 715 A2 4/2007
EP 1772715 A2 4/2007

(56) References Cited

FOREIGN PATENT DOCUMENTS

| | | | |
|---|---|---|---|
| EP | 1 961 912 | A1 | 8/2008 |
| EP | 1 961 913 | A1 | 8/2008 |
| EP | 1961912 | A1 | 8/2008 |
| EP | 1961913 | A1 | 8/2008 |
| EP | 2085566 | A2 | 8/2009 |
| EP | 2 322 357 | A1 | 5/2011 |
| EP | 3032025 | A1 | 6/2016 |
| GB | 1487948 | A | 10/1977 |
| GB | 2 077 812 | A | 12/1981 |
| GB | 2077812 | A | 12/1981 |
| GB | 2 180 027 | A | 3/1987 |
| GB | 2180027 | A | 3/1987 |
| GB | 2 228 025 | A | 8/1990 |
| GB | 2228025 | A | 8/1990 |
| GB | 2 314 391 | A | 12/1997 |
| GB | 2314391 | A | 12/1997 |
| WO | 02068788 | A2 | 9/2002 |
| WO | 2004/079153 | A2 | 9/2004 |
| WO | 2004079153 | A2 | 9/2004 |
| WO | 2004/101417 | A2 | 11/2004 |
| WO | 2004101417 | A2 | 11/2004 |
| WO | 2007/001887 | A2 | 1/2007 |
| WO | 2007001887 | A2 | 1/2007 |
| WO | 2007/070805 | A2 | 6/2007 |
| WO | 2007127737 | A2 | 11/2007 |
| WO | 2008005767 | A1 | 1/2008 |
| WO | 2009/076648 | A2 | 6/2009 |
| WO | 2009/76648 | A2 | 6/2009 |
| WO | 2009076648 | A2 | 6/2009 |
| WO | 2012100019 | A1 | 7/2012 |
| WO | 2012/115717 | A2 | 8/2012 |
| WO | 2012115717 | A2 | 8/2012 |
| WO | 2014056092 | A1 | 4/2014 |
| WO | 2014/182272 | A1 | 11/2014 |
| WO | 2015/000023 | A1 | 1/2015 |
| WO | 2015000023 | A1 | 1/2015 |
| WO | 2015/119509 | A1 | 8/2015 |
| WO | 2015/127433 | A1 | 8/2015 |
| WO | 2015119509 | A1 | 8/2015 |
| WO | 2015127433 | A1 | 8/2015 |
| WO | 2015176121 | A1 | 11/2015 |
| WO | 2016197255 | A1 | 12/2016 |
| WO | 2017/044384 | A1 | 3/2017 |

OTHER PUBLICATIONS

EPO Partial European Search Report dated Oct. 4, 2018, for European Patent Application No. 18159598.4.
EPO Extended European Search Report dated Oct. 5, 2018, for European Patent Application No. 18173275.1.
EPO Extended European Search Report dated Nov. 6, 2018, for European Application No. 18159597.6.
International Search Report and Written Opinion in PCT/US2018/042812 dated Oct. 17, 2018.
Extended Search Report in application EP18177312.8 dated Nov. 6, 2018.
Balltec Lifting Solutions, CoilLOK™, Brochure, "Highest integrity hand-held coiled tubing handling tools," 2 pages.
Canadian Office Action in related application CA 2,955,754 dated Jul. 17, 2018.
EPO Extended European Search Report dated Jul. 19, 2018, for European Application No. 18159595.0.
EPO Extended European Search Report dated Jul. 17, 2018, for European Application No. 18158050.7.
Cookson, Colter, "Inventions Speed Drilling, Cut Costs," The American Oil & Gas Reporter, Sep. 2015, 2 pages.
Ennaifer, Amine et al. , "Step Change in Well Testing Operations," Oilfield Review, Autumn 2014: 26, No. 3, pp. 32-41.
Balltec Lifting Solutions, LiftLOK™ Brochure, "Highest integrity lifting tools for the harshest environments," 2 pages.
Peters; Tool Coupler for Use With a Top Drive; U.S. Appl. No. 15/656,508, filed Jul. 21, 2017. (Application not attached to IDS.).
Fuehring et al.; Tool Coupler With Rotating Coupling Method for Top Drive; U.S. Appl. No. 15/445,758, filed Feb. 28, 2017. (Application not attached to IDS.).
Bell; Interchangeable Swivel Combined Multicoupler; U.S. Appl. No. 15/607,159, filed May 26, 2017 (Application not attached to IDS.).
Amezaga; Dual Torque Transfer for Top Drive System; U.S. Appl. No. 15/447,881, filed Mar. 2, 2017. (Application not attached to IDS.).
Zouhair; Coupler With Threaded Connection for Pipe Handler; U.S. Appl. No. 15/444,016, filed Feb. 27, 2017. (Application not attached to IDS.).
Liess; Downhole Tool Coupling System; U.S. Appl. No. 15/670,897, filed Aug. 7, 2017. (Application not attached to IDS.).
Muller et al; Combined Multi-Coupler With Rotating Locking Method for Top Drive; U.S. Appl. No. 15/721,216, filed Sep. 29, 2017. (Application not attached to IDS.).
Amezaga et al; Tool Coupler With Threaded Connection for Top Drive; U.S. Appl. No. 15/457,572, filed Mar. 13, 2017. (Application not attached to IDS.).
Wiens; Combined Multi-Coupler With Locking Clamp Connection for Top Drive; U.S. Appl. No. 15/627,428, filed Jun. 19, 2017. (Application not attached to IDS.).
Henke et al.; Tool Coupler With Sliding Coupling Members for Top Drive; U.S. Appl. No. 15/448,297, filed Mar. 2, 2017. (Application not attached to IDS.).
Schoknecht et al.; Combined Multi-Coupler With Rotating Fixations for Top Drive; U.S. Appl. No. 15/447,926, filed Mar. 2, 2017. (Application not attached to IDS.).
Metzlaff et al.; Combined Multi-Coupler for Top Drive; U.S. Appl. No. 15/627,237, filed Jun. 19, 2017 (Application not attached to IDS.).
Liess; Combined Multi-Coupler for Top Drive; U.S. Appl. No. 15/656,914, filed Jul. 21, 2017. Application not attached to IDS.).
Liess et al.; Combined Multi-Coupler; U.S. Appl. No. 15/656,684, filed Jul. 21, 2017. (Application not attached to IDS).
Amezaga et al.; Tool Coupler With Data and Signal Transfer Methods for Top Drive; U.S. Appl. No. 15/730,305, filed Oct. 11, 2017. (Application not attached to IDS).
Liess; Tool Coupler With Threaded Connection for Top Drive; U.S. Appl. No. 15/806,560, filed Nov. 8, 2017. (Application not attached to IDS).
EPO Partial European Search Report dated Jul. 31, 2018, for European Application No. 18159597.6.
A123 System; 14Ah Prismatic Pouch Cell; Nanophosphate® Lithium-Ion; www.a123systems.com; date unknown; 1 page.
Streicher Load/Torque Cell Systems; date unknown; 1 page.
3PS, Inc.; Enhanced Torque and Tension Sub with Integrated Turns; date unknown; 2 total pages.
Lefevre, et al.; Drilling Technology; Deeper, more deviated wells push development of smart drill stem rotary shouldered connections; dated 2008; 2 total pages.
PCT Invitaiton to Pay Additional Fees for International Application No. PCT/US2008/086699; dated Sep. 9, 2009; 7 total pages.
PCT Notification of Transmittal of the International Search Report and the Written Opinion of the International Searching Authority for International Application No. PCT/US2008/086699; dated Sep. 11, 2009; 19 total pages.
National Oilwell Varco; Rotary Shoulder Handbook; dated 2010; 116 total pages.
Weatherford; TorkSub™ Stand-Alone Torque Measuring System; dated 2011-2014; 4 total pages.
Australian Examination Report for Application No. 2008334992; dated Apr. 5, 2011; 2 total pages.
European Search Report for Application No. 08 860 261.0-2315; dated Apr. 12, 2011; 4 total pages.
Eaton; Spool Valve Hydraulic Motors; dated Sep. 2011; 16 total pages.
European Extended Search Report for Application No. 12153779.9-2315; dated Apr. 5, 2012; 4 total pages.
Australian Examination Report for Application No. 2012201644; dated May 15, 2013; 3 total pages.

(56) References Cited

OTHER PUBLICATIONS

Warrior; 250E Electric Top Drive (250-TON); 250H Hydraulic Top Drive (250-TON); dated Apr. 2014; 4 total pages.
Hydraulic Pumps & Motors; Fundamentals of Hydraulic Motors; dated Jun. 26, 2014; 6 total pages.
Warrior; Move Pipe Better; 500E Electric Top Drive (500 ton-1000 hp); dated May 2015; 4 total pages.
Canadian Office Action for Application No. 2,837,581; dated Aug. 24, 2015; 3 total pages.
European Extended Search Report for Application No. 15166062.8-1610; dated Nov. 23, 2015; 6 total pages.
Australian Examination Report for Application No. 2014215938; dated Feb. 4, 2016; 3 total pages.
Rexroth; Bosch Group; Motors and Gearboxes; Asynchronous high-speed motors 1 MB for high speeds; dated Apr. 13, 2016; 6 total pages.
Canadian Office Action for Application No. 2,837,581; dated Apr. 25, 2016; 3 total pages.
PCT Notification of Transmittal of the International Search Report and the Written Opinion of the International Searching Authority for International Application No. PCT/US2015/061960; dated Jul. 25, 2016; 16 total pages.
PCT Notification of Transmittal of the International Search Report and the Written Opinion of the International Searching Authority for International Application No. PCT/US2016/049462; dated Nov. 22, 2016; 14 total pages.
PCT Notification of Transmittal of the International Search Report and the Written Opinion of the International Searching Authority for International Application No. PCT/US2016/050542; dated Nov. 25, 2016; 13 total pages.
PCT Notification of Transmittal of the International Search Report and the Written Opinion of the International Searching Authority for International Application No. PCT/US2016/046458; dated Dec. 14, 2016; 16 total pages.
PCT Notification of Transmittal of the International Search Report and the Written Opinion of the International Searching Authority for International Application No. PCT/US2016/047813; dated Jan. 12, 2017; 15 total pages.
PCT Notification of Transmittal of the International Search Report and the Written Opinion of the International Searching Authority for International Application No. PCT/US2016/050139; dated Feb. 20, 2017; 20 total pages.
PCT Notification of Transmittal of the International Search Report and the Written Opinion of the International Searching Authority for International Application No. PCT/US2017/014646; dated Apr. 4, 2017; 14 total pages.
PCT Notification of Transmittal of the International Search Report and the Written Opinion of the International Searching Authority for International Application No. PCT/US2017/014224; dated Jun. 8, 2017; 15 total pages.
European Extended Search Report for Application No. 17152458.0-1609; dated Jun. 8, 2017; 7 total pages.
Australian Examination Report for Application No. 2017200371; dated Sep. 19, 2017; 5 total pages.
European Extended Search Report for Application No. 17195552.9-1614; dated Dec. 4, 2017; 6 total pages.
Australian Examination Report for Application No. 2017200371; dated Feb. 8, 2018; 6 total pages.
Canadian Office Action for Application No. 2,955,754; dated Mar. 28, 2018; 3 total pages.
Australian Examination Report for Application No. 2017200371; dated May 2, 2018; 4 total pages.
Canadian Office Action for Application No. 2,974,298; dated May 16, 2018; 3 total pages.
EPO Extended European Search Report dated Jun. 6, 2018, for European Application No. 18157915.2.
Australian Examination Report dated May 15, 2013, Australian Patent Applicatin No. 2012201644.
PCT Search Report for International Application No. PCT/US2008/086699 dated Nov. 9, 2009.
Australian Examination Report for Application No. 2008334992 dated Apr. 5, 2011.
EP Office Action for Application No. 08860261.0-2315 dated Apr. 12, 2011.
EP Search Report for Application No. 12153779.9-2315 dated Apr. 5, 2012.
PCT Search Report for International Application No. PCT/US2008/086699 dated Sep. 9, 2009.
Canadian Office Action dated Aug. 24, 2015, for corresponding Application No. 2,837,581.
EPO Extended European Search Report dated Nov. 23, 2015, for EPO Patent Application No. 15166062.8.
Australian Patent Examination Report dated Feb. 4, 2016, for Australian Patent Application No. 2014215938.
Canadian Office Action dated Apr. 25, 2016, for Canadian Patent Application No. 2,837,581.
PCT International Search Report and Written Opinion dated Jul. 25, 2016, for International Patent Application No. PCT/US2015/061960.
EPO Extended European Search Report dated Dec. 4, 2017, for European Application No. 17195552.9.
PCT International Search Report and Written Opinion dated Feb. 20, 2017 for International Application No. PCT/US2016/050139.
PCT International Search Report and Written Opinion dated Dec. 14, 2016, for International Patent Application No. PCT/US2016/046458.
PCT International Search Report and Written Opinion dated Nov. 11, 2016, for International Application No. PCT/US2016/046445.
"Fundamentals of Hydraulic Motors," Staff Report, Hydraulics and Pneumatics, Jun. 26, 2014, http://hydraulicspneumatics.com/hydraulic-pumps-motors/fundamentals-hydraulic-motors, accessed Aug. 12, 2015 (6 total pages).
A123 Systems, 14Ah Prismatic Pouch Cell, Product Specification, www.a123systems.com.
Eaton Low Speed High Torque Motors E-MOLO-MC001-E6 Brochure, Sep. 2011 (16 total pages).
Warrior, 250E Electric Top Drive (250-TON), 25011 Hydraulic Top Drive (250-TON), Brochure, Apr. 2014, Rev. 1, www.warriorrig.com.
Warrior, 500E Electric Top Drive (500 ton-1000hp), Brochure, Document No. EC 009, May 2015, Rev. 3, www.warriorrig.com.
Weatherford, TorkSub™ Stand-Alone Torque Measuring System, Product Specification, Document No. 11368.00, Copyright 2011-2014, www.weatherford.com.
PCT International Search Report and Written Opinion dated Nov. 25, 2016, for International Patent Application No. PCT/US2016/050542.
Streicher Load/Torque Cell System Brochure, Streicher Group, 1 Page.
Enchanced Torque & Tension Sub With Integrated Turns Brochure, 3PS, Inc.,, 2 Pages.
PCT International Search Report and Written Opinion dated Jan. 12, 2017, for International Patent Application No. PCT/US2016/047813.
PCT International Search Report and Written Opinion dated Nov. 22, 2016, for International Patent Application No. PCT/US2016/049462.
PCT International Search Report and Written Opinion dated Apr. 4, 2017, for International Application No. PCT/US2017/014646.
Warrior, 250E Electric Top Drive (250-TON), 250H Hydraulic Top Drive (250-TON), Brochure, Apr. 2014, Rev. 1.
Warrior, 500E Electric Top Drive (500 ton-1000hp), Brochure, Document No. EC 009, May 2015, Rev. 3.
Weatherford, TorkSub™ Stand-Alone Torque Measuring System, Product Specification, Document No. 11368.00, www.weatherford.com.
EPO Extended Europeam Search RPT dated Jun. 8, 2017 for European Pat. Application No. 17152458.0.
EPO Extended European Search Report dated Jun. 8, 2017, for European Patent Application No. 17152458.0.
Australian Examination Report dated Sep. 19, 2017, for Australian Patent Application No. 2017200371.

(56) References Cited

OTHER PUBLICATIONS

Australian Examination Report dated Feb. 8, 2018 for Australian Patent Application No. 2017200371.
PCT International Search Report and Written Opinion dated Jun. 8, 2017, for Internaitonal Application No. PCT/US2017/014224.
Lefevre,Bruno et al., "Deeper, more deviated wells push development of smart drill stem rotary shouldered connections," Drilling Technology, (2008), pp. 130-132.
Rotary Sholder Handbook, 2010 National Oilwell Varco, D392002466-MKT-001 Rev.02,116 pages.
Weatherford; Rotaflex Long-Stroke Pumping Units; Artificial Lift Systems; date unknown; 17 total pages.
Analog Devices; Data Sheet; Precision ±1.7 g, ±5 g, ±18 g Single-/Dual-Axis iMEMSÒ Accelerometer; 2004-2014; 16 total pages.
Dr. Richard Thornton; Elevator World; Linear Synchronous Motors for Elevators; dated Sep. 2006; 2 total pages.
Weatherford; Production Optimization; Stainless Steel Polished-Rod Load Cell dated 2008; 2 total pages.
Wieler, et al.; Elevator World; Linear Synchronous Motor Elevators Become a Reality; dated May 2012; 4 total pages.
MagneMotion; LSM Elevators; White Paper dated 2013; 2 total pages.
Weatherford; Rotaflex Long-Stroke Pumping Units; Proven Technology for Deep, Challenging, and High-Volume Wells; dated 2014; 24 total pages.
U.S. Appl. No. 14/717,441 entitled Dart Detector for Wellbore Tubular Cementation in the name of Zippel, et al; 35 total pages; filed May 20, 2015.
PCT International Search Report and Written Opinion dated Aug. 24, 2016, for International Application No. PCT/ US2016/015838.
Bosch Rexroth AG, Electric Drives and Controls, Brochure, "Asynchronous high-speed motors 1MB for high speeds," 6 pages.

* cited by examiner

COMBINED MULTI-COUPLER FOR TOP DRIVE

BACKGROUND OF THE INVENTION

Field of the Invention

The present disclosure generally relates to methods and apparatus for coupling a top drive to a tool for use in a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Top drives are equipped with a motor for rotating the drill string. The quill of the top drive is typically threaded for connection to an upper end of the drill pipe in order to transmit torque to the drill string. Conventional top drives also threadedly connect to tools for use in the wellbore. An operator on the rig may be required to connect supply lines, such as hydraulic, pneumatic, data, and/or power lines, between conventional top drives and the tool to complete the connection. The threaded connection between top conventional top drives and tools allows only for rotation in a single direction. Manual connection of supply lines can be time-consuming and dangerous to rig personnel. Therefore, there is a need for improved apparatus and methods for connecting top drives to tools.

SUMMARY OF THE INVENTION

The present disclosure generally relates to methods and apparatus for coupling a top drive to a tool for use in a wellbore.

In one embodiment, a coupling system for a top drive and a tool includes a housing of the top drive having a bore therethrough, an adapter of the tool, a latch member at least partially disposed within the housing and radially movable between an extended position and a retracted position, wherein the latch member is configured to longitudinally couple the housing to the adapter, and a lock member at least partially disposed within the housing and longitudinally movable relative to the housing, wherein the lock member is configured to move the latch member between the extended and the retracted positions.

In one embodiment, a coupling system for a top drive includes a housing having a bore therethrough, a latch member at least partially disposed within the housing and radially movable between an extended position and a retracted position, wherein the latch member is configured to longitudinally couple the housing to a tool, and a lock member longitudinally movable relative to the housing and configured to move the latch member between the extended and the retracted positions.

In another embodiment, a coupling system for coupling a top drive to a tool includes a housing having a bore therethrough, a sleeve disposed on an outer surface of the housing, a latch member disposed on an outer surface of the sleeve, wherein the latch member is configured to longitudinally couple the housing to the tool, and a tool dock integrally formed with the tool and configured to receive the latch member.

In another embodiment, a coupling system for coupling a top drive includes a housing having a bore therethrough, a latch member at least partially disposed through a wall of the housing and rotatable relative to the housing, wherein the latch member is configured to longitudinally couple the housing to a tool, and an actuator disposed on an outer surface of the housing and configured to rotate the latch member.

In another embodiment, a method of coupling a top drive and a tool includes moving a top drive adjacent a tool, the top drive including a housing, a lock member at least partially disposed within the housing, and a latch member at least partially disposed within the housing and the tool including an adapter. The method further includes inserting the adapter into the housing, shifting the lock member longitudinally relative to the housing, and moving the latch member radially between an extended position and a retracted position to couple the top drive and the tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
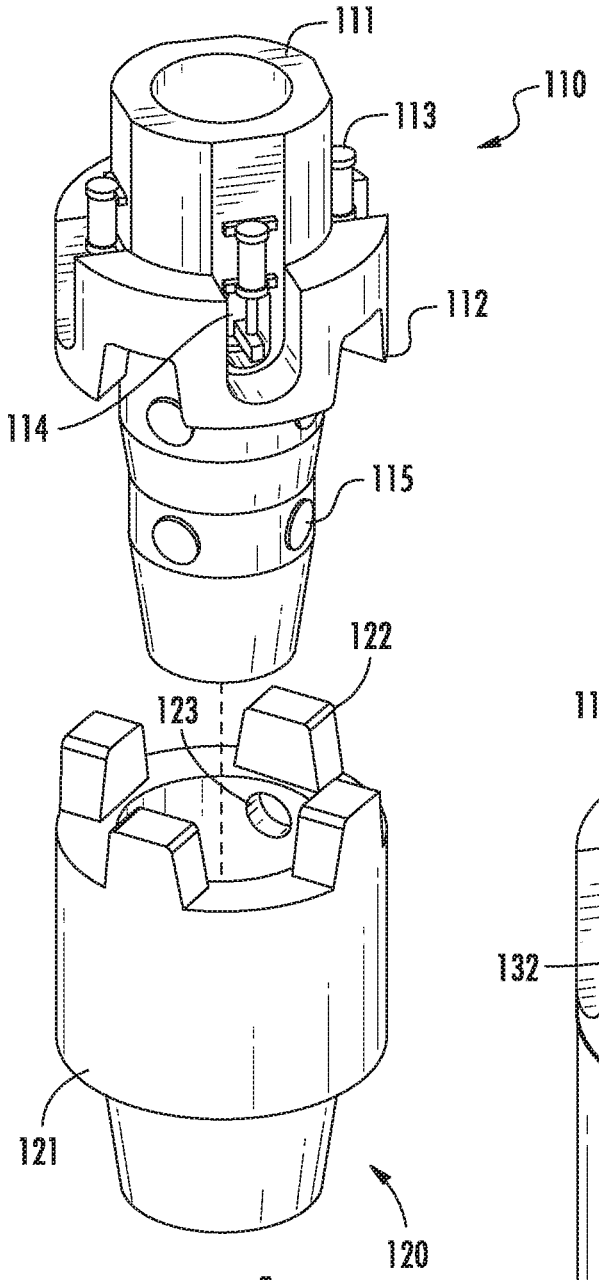
FIG. 1 illustrates an isometric view of a combined multi-coupler system according to a first embodiment.
Figure 2:
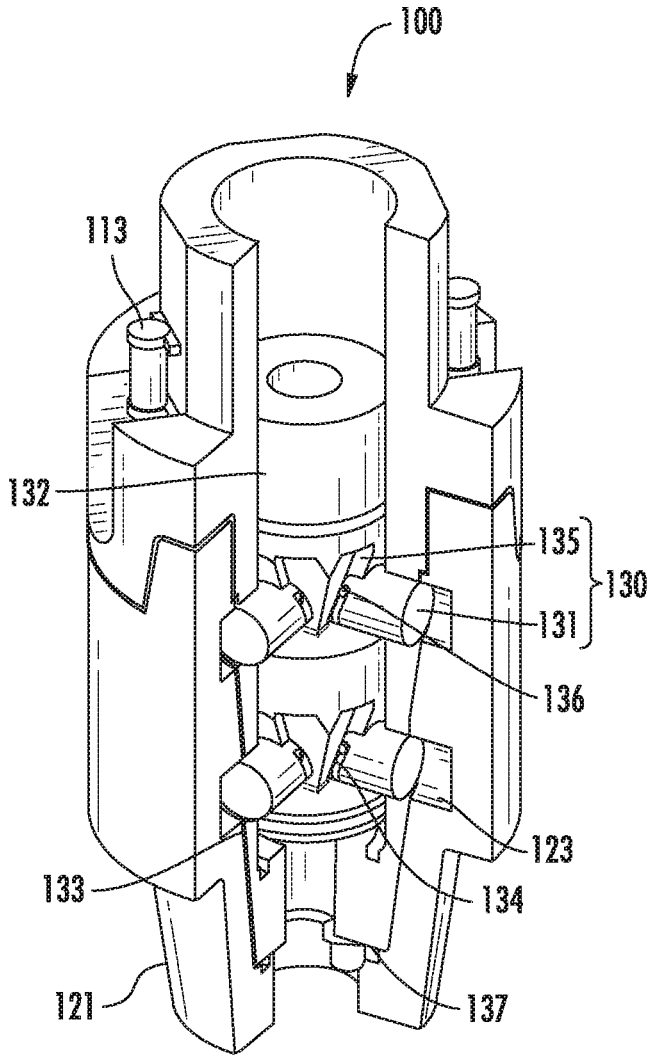
FIG. 2 illustrates a partial cross-sectional view of the combined multi-coupler system according to the first embodiment.

FIGS. 1 and 2 illustrate a combined multi-coupler system (CMC) 100, according to a first embodiment. The CMC 100 includes a drive member 110, a tool dock 120, and latch assembly 130. The drive member 110 may be integrally formed with the top drive. The drive member 110 may include a housing 111. The housing 111 may be tubular having a bore therethrough. The housing 111 may include a connector section, a torque transfer section, and a cone section. The connector section may be disposed at an upper longitudinal end of the housing 111. An upper longitudinal end of the connector section may be integrally formed with the top drive. The connector section may be tubular having a bore therethrough. The torque transfer section may be disposed beneath the connector section and include drive keys 112. Drive keys 112 may be formed on an outer surface of the housing 111. The drive keys 112 may be trapezoidal in shape. The drive keys 112 may have a recess formed therein for receiving adapter keys 122 of the tool dock 120. An actuator assembly, such as piston and cylinder 113, may be disposed on the outer surface of the housing 111. A port 114 may be formed through a wall of the housing 111 adjacent the actuator assembly. A U-shaped groove may be formed through the drive keys 112 and around the port 114. The cone section may be disposed beneath the torque transfer section. A plurality of ports 115 may be formed through a wall of the housing 111. The ports 115 may be disposed through the housing 111 below the drive keys 112.

The tool dock 120 may include the adapter 121. The adapter 121 may be integrally formed with the tool dock 120. The adapter 121 may be tubular having a bore therethrough. The adapter 121 may be configured to receive the cone section of the housing 111 therein. The adapter 121 may have adapter keys 122 formed at a longitudinal end thereof. The adapter keys 122 may be trapezoidal in shape. Recesses in the adapter keys 122 may be configured to receive the drive keys 112. The drive keys 112 may engage the adapter keys 122 and transfer torque between the top drive and the tool dock 120. A plurality of recesses 123 may be formed in an inner surface of the adapter 121. The recesses 123 may be partially formed through a wall of the adapter 121. The recesses 123 may be configured to align with the ports 115 of the housing 111. The adapter keys 122 may assist in aligning the ports 115 with the recesses 123. A seal 137 may be disposed at a lower longitudinal end of the adapter. The seal 137 may be disposed in a groove of the adapter 121. The seal 137 may prevent fluids from entering any gap between the adapter 121 and the drive member housing 111.

The latch assembly 130 may include a latch member, such as connection pins 131, and a lock member, such as shift wedge 132. Connection pins 131 may be cylindrical in shape. A first set of connection pins 131 may be spaced ninety degrees apart around the circumference of the shift wedge 132. A second set of connection pins 131 may be located around the circumference of the shift wedge 132 beneath the first set. Ports 115 and recesses 123 may be configured to receive the connection pins 131. Connection pins 131 may have a channel 134 formed therethrough. The connection pins 131 may have a tapered groove formed along an outer surface thereof. Corresponding tapered surfaces 135 may be formed on the shift wedge 132. The connection pins 131 may be radially movable between a retracted position, shown in FIGS. 2 and 3A, and an extended position, shown in FIG. 3B. The recesses 123 may be configured to receive the connection pins 131 in the extended position. The connection pins 131 may be at least partially disposed in the recesses 123 in the extended position. The shift wedge 132 may be tubular having a bore therethrough. The shift wedge 132 may be disposed in the bore of the housing 111. Seals 133 may be disposed at opposite longitudinal ends of the shift wedge 132. The piston and cylinder assembly 113 may be at least partially disposed through the port 114. Piston and cylinder assembly 113 may be connected to the shift wedge 132 through the port 114. The shift wedge 132 may be longitudinally movable relative to the housing 111 and the adapter 121. The shift wedge 132 may be longitudinally movable within the bore of the housing 111. The piston and cylinder assembly 113 may be configured to longitudinally move the shift wedge 132 within the bore of the housing 111. The shift wedge 132 may include tapered surfaces 135. The tapered surfaces 135 may correspond to the tapered grooves formed in the connection pins 131. The tapered surfaces 135 and tapered grooves may function as a tongue-and-groove connection. The connection pins 131 may be configured to move longitudinally relative to the shift wedge 132 and along the tapered surfaces 135. The tapered surfaces 135 may be configured to engage and extend the connection pins 131 through the ports 115 and into the recesses 123 of the adapter 121. A projection 136 may extend from the tapered surfaces 135. The projection 136 may be circular. The channel 134 may be configured to receive the projection 136. The projection 136 may be configured to move through the channel 134.

Alternatively, the drive keys 112 and adapter keys 122 may be omitted and the connection pins 131 may provide the longitudinal and the torsional coupling between the drive member 110 and the tool dock 120. The connection pins 131 support the axial load of the tool dock 120 and attached tool and transfer torque between the drive member 110 and the tool dock 120.

Figure 3A:
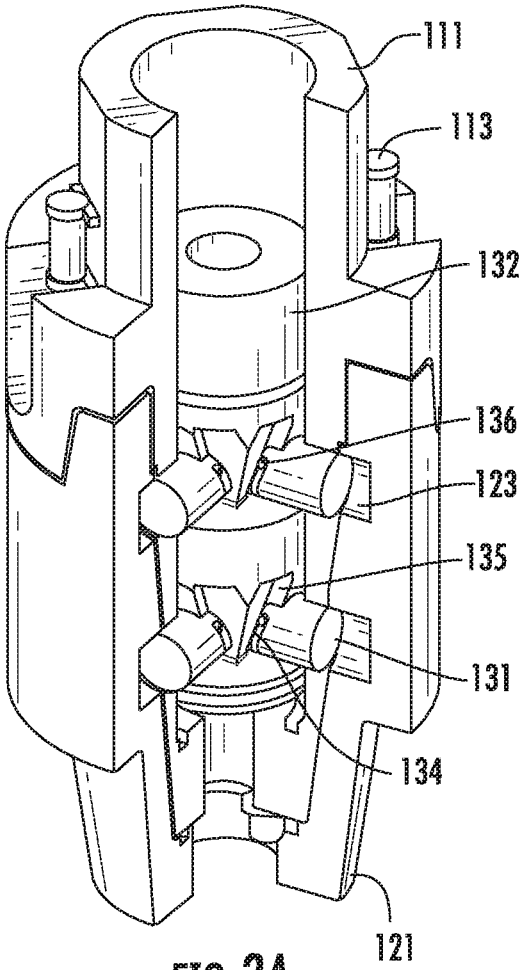
FIGS. 3A and 3B illustrate operation of the combined multi-coupler system according to the first embodiment.
Figure 3B:
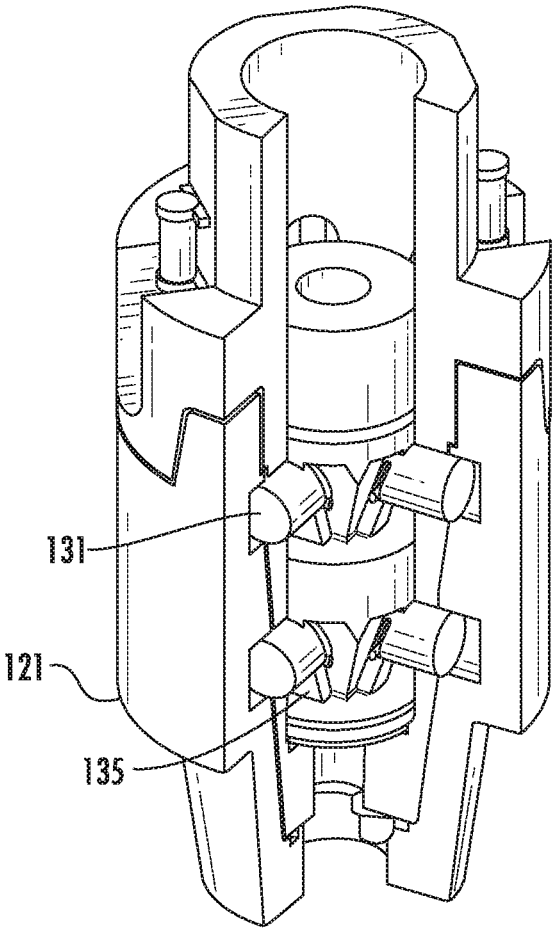

FIGS. 3A and 3B illustrate operation of the CMC 100. The CMC 100 is operable to torsionally and longitudinally couple the top drive to the tool. First, the housing 111 is inserted into the bore of the adapter 121. The tool dock 120 may be raised or the drive member 110 lowered to begin the process. As the housing 111 is inserted into the bore of the adapter 121, the drive keys 112 assist in aligning the connection pins 133 with the recesses 123. Recesses in the drive keys 112 receive the adapter keys 122. Likewise, the recesses in the adapter keys 122 receive the drive keys 112. As shown in FIG. 3A, the housing 111 has been inserted into the bore of the adapter 121. The engaged drive keys 112 and adapter keys 122 transfer torque between the tool and the top drive. Next, the piston and cylinder assembly 113 is actuated to longitudinally move the shift wedge 132 within the bore of the housing 111. The connection pins 133 are restrained from longitudinal movement relative to the housing 111 by walls of the holes 115. The channel 134 and projection 136 permit longitudinal movement of the shift wedge 132 relative to the connection pins 131. The projection 136 moves through the channel 134 as the shift wedge 132 longitudinally moves relative to the housing 111. As the shift wedge 132 longitudinally moves towards a lower end of the housing 111, the connection pins 131 slide along the tapered surfaces 135 to the extended position, shown in FIG. 3B. In the extended position, the connection pins 133 are received in the recesses 123 of the adapter 121. Reception of the connection pins 131 in the recesses 123 longitudinally couples the drive member 110 to the tool dock 120. In addition, the reception of the connection pins 131 may torsionally couple the drive member 110 to the tool dock 120 and compensate for the axial load hanging beneath the tool dock 120. Reception of the connection pins 131 in the recesses 123 rotationally couples the top drive to the tool bidirectionally. The shift wedge 132 retains the connection pins 131 in the extended position.

In order to decouple the top drive and the tool, the piston and cylinder assembly 113 is actuated to longitudinally move the shift wedge 132 towards the upper end of the housing 111. The connection pins 131 slide along the tapered surfaces 135 to the retracted position, shown in FIG. 3A. Movement of the connection pins 131 out of the recesses 123 longitudinally decouples the drive member 110 and the tool dock 120. The drive member 110 is then lifted or the tool dock 120 lowered to disengage the drive keys 112 and the adapter keys 122, thereby rotationally decoupling the drive member 110 and the tool dock 120.

Figure 4:
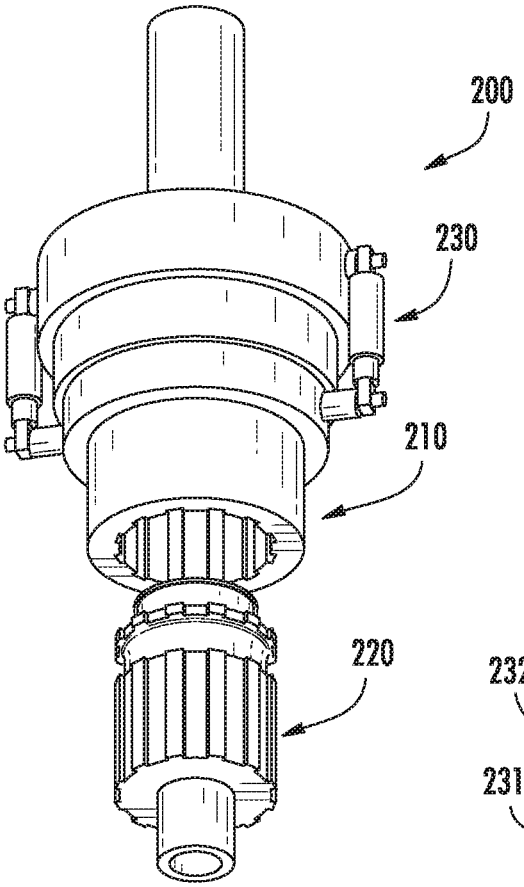
FIG. 4 illustrates an isometric view of a combined multi-coupler system according to a second embodiment.
Figure 5:
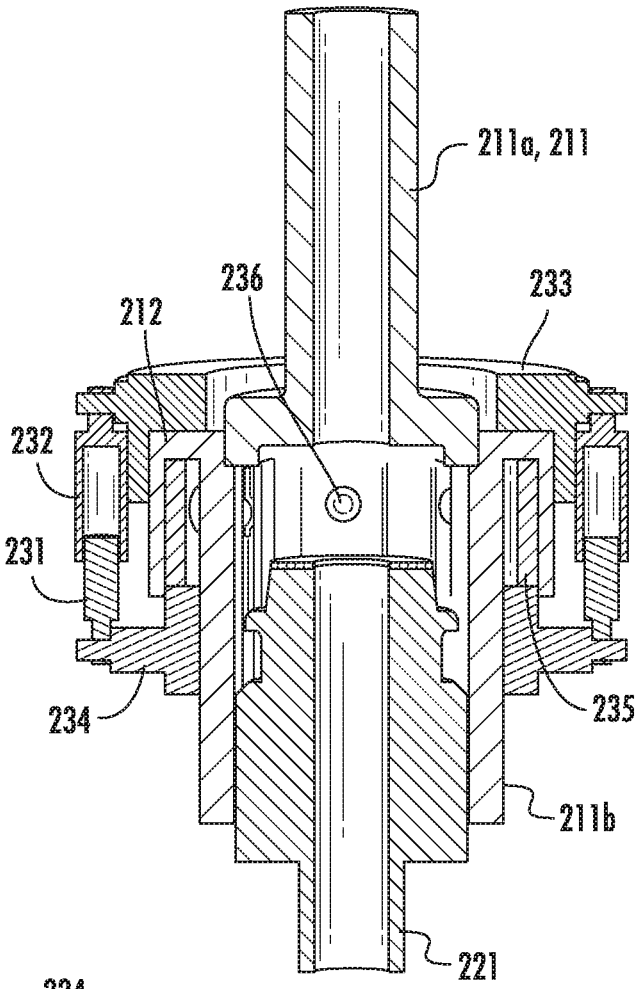
FIG. 5 illustrates a cross-sectional view of the combined multi-coupler system according to a second embodiment.

FIGS. 4 and 5 illustrate a CMC system 200, according to a second embodiment. The CMC 200 may include a drive member 210, a tool dock 220, and a latch assembly 230. The drive member 210 may include a housing 211. The housing 211 may have a bore therethrough. The housing 211 may be integrally formed with the top drive. The housing 211 may include one or more sections 211*a,b*. An upper tubular section 211*a* of the housing 211 may be integrally formed with the top drive at an upper longitudinal end thereof. The tubular section 211*a* may include a coupling, such as a threaded coupling, formed at a lower longitudinal end thereof for connection to a lower housing section 211*b*. Alternatively, the housing 211 may be a single piece. The lower housing section 211*b* may have a bore therethrough. The lower housing section 211*b* may be configured to receive an adapter 221 of the tool dock 220. The lower housing section 211*b* may have a flange 212 formed at an upper longitudinal end thereof. The flange 212 may be integrally formed with the housing section 211*b*. A recess may be disposed between an outer surface of the housing section 211*b* and the flange 212. A port 213 (FIG. 7A) may be formed through a wall of the housing section 211*b*. The port 213 may be disposed through a wall adjacent the recess. Splines may be formed along an inner surface of the housing section 211*b*. The splines may extend radially inward from the inner surface of the housing section 211*b*. The splines may assist in alignment during insertion of the adapter 221 of the tool dock 220.

The latch assembly 230 may include a piston 231 and cylinder 232 assembly, a bracket 233, a lock member, such as thrust sleeve 234, a first biasing member, such as main spring 235, and a latch member, such as pin 236. The bracket 233 may be an annular ring. The bracket 233 may be disposed on an outer surface of the housing 211. The bracket 233 may be supported by the flange 212 of the housing 211. The cylinder 232 may be connected to the bracket. A fluid line may be connected to the cylinder 232 to operate the piston 231 and cylinder 232 assembly. A longitudinal end of the piston 231 may be disposed in the cylinder 232 and longitudinally movable relative thereto. A longitudinal end of the piston opposite the cylinder 232 may be connected to the thrust sleeve 234. The piston 231 and cylinder 232 assembly may be configured to longitudinally move the thrust sleeve 234 relative to the housing 211. The thrust sleeve 234 may be an annular ring. The thrust sleeve 234 may be disposed on an outer surface of the housing 211. The thrust sleeve 234 may be at least partially disposed in the recess between the flange 212 and the housing section 211*b*. The thrust sleeve 234 may be longitudinally movable relative to the housing 211 between an extended position, shown in FIG. 7A, and a retracted position, shown in FIG. 7B. The main spring 235 may be disposed in the recess between the flange 212 and the housing section 211*b*. The main spring 235 may be an annular ring. The main spring 235 may be an elastomer, such as rubber. The main spring 235 may be supported by an upper longitudinal end of the thrust sleeve 234. The main spring 235 may be longitudinally constrained in the recess between the thrust sleeve 234 and the flange 212. The thrust sleeve 234 may be configured to compress the main spring 235. The main spring 235 may be configured to radially expand within the recess when subjected to longitudinal compression by the thrust sleeve 234. The main spring 235 may be configured to engage the pin 236 during radial expansion. The thrust sleeve 234 may be configured to engage the main spring 235. The pin 236 may be at least partially disposed in the recess between the flange 212 and the housing section 211*b*. The pin 236 may be radially movable between a retracted position, shown in FIG. 7A, and an extended position, shown in FIG. 7B. The thrust sleeve 234 may be configured to retain the pin 236 in the extended position. The pin 236 may have a lip configured to prevent the pin from falling into the bore of the housing section 211*b*. A biasing member, such as circular spring 237 (FIG. 7A), may be disposed around the pin 236. The circular spring 237 may be disposed between the shoulder of the pin and the outer surface of the housing section 211*b*. The circular spring 237 may be disposed in a recess of the housing section 211*b*. The circular spring 237 may be an elastomer. The circular spring 237 may bias the pin 236 towards the retracted position.

Figure 6:
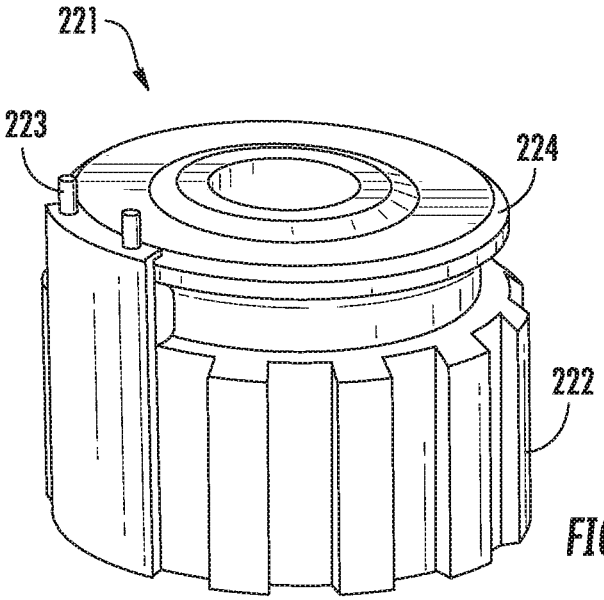
FIG. 6 illustrates a tool dock according to the second embodiment.

FIG. 6 illustrates the tool dock 220 of the CMC 200. The tool dock 220 includes an adapter 221. The adapter 221 may be tubular having a bore therethrough. Splines 222 may be formed along an outer surface of the adapter 221. Splines 222 may be configured to engage corresponding splines on the inner surface of the housing section 211*b*. The adapter 221 may include quick connection pins 223 disposed at a longitudinal end thereof. The quick connection pins 223 may stab into receivers formed in an inner surface of the housing section 211*a*. The quick connection pins 223 may be configured to transfer power, data, electronics, hydraulics, and/or pneumatics between the top drive and the tool. A lip 224 may be formed at a longitudinal end of the adapter 221. An annular recess may be formed between the lip 224 and the splines 222 of the adapter 221.

Figure 7A:
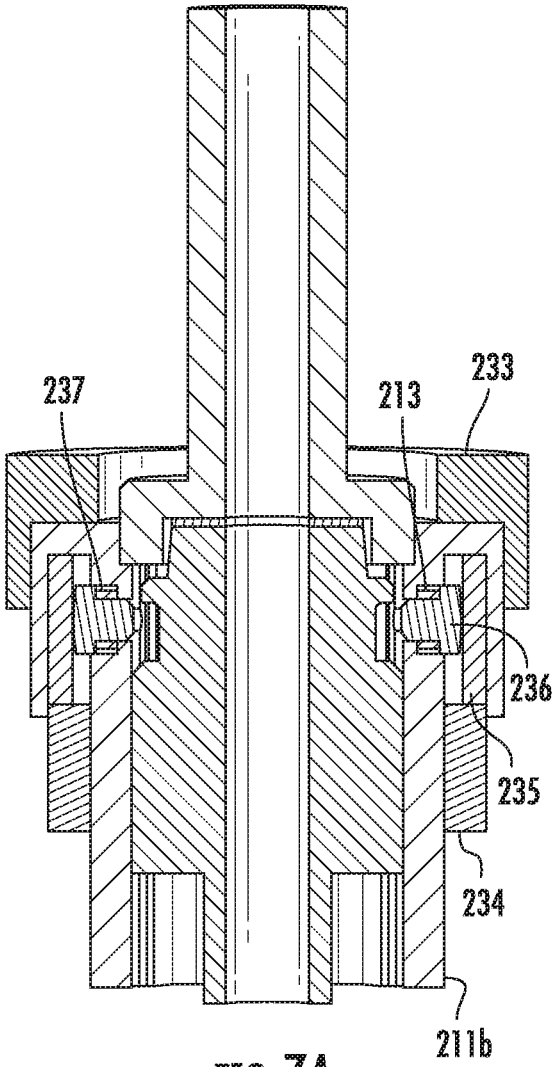
FIGS. 7A and 7B illustrate operation of the combined multi-coupler system according to the second embodiment.
Figure 7B:
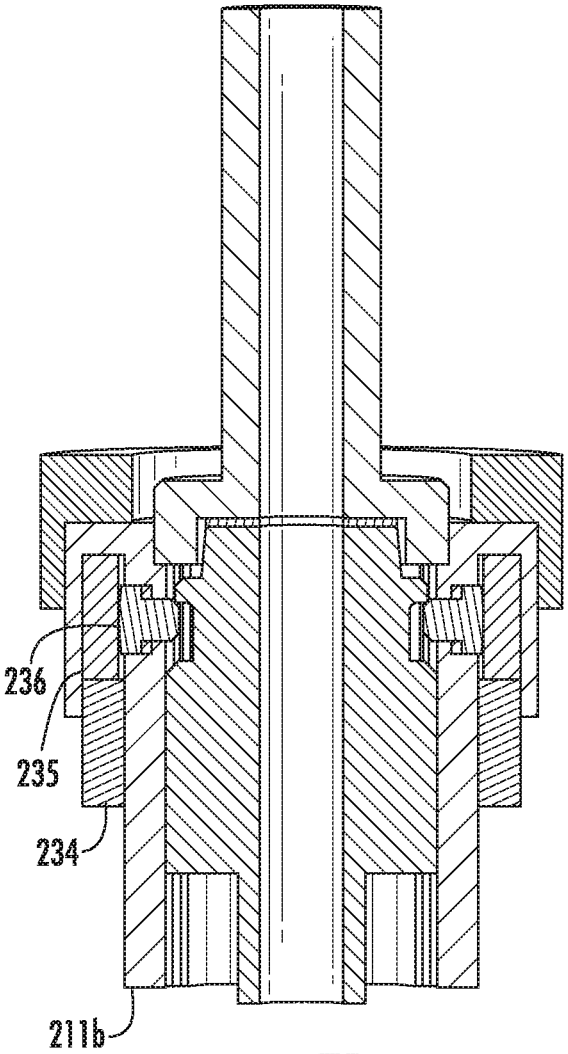

FIGS. 7A and 7B illustrate operation of the CMC 200. The CMC 200 is operable to torsionally and longitudinally couple the top drive to the tool. First, the adapter 221 is inserted into the bore of the housing 211. The tool dock 220 may be raised or the drive member 210 lowered to begin the process. The splines on the adapter 221 and housing section 211*b* facilitate alignment. In addition, the splines on the adapter 221 and the housing section 211*b* torsionally couple the housing 211 of the drive member 210 and the adapter 221 the tool dock 220. Reception of the splines of the adapter within the recesses between the splines on the housing section 211*b* rotationally couples the top drive to the tool bidirectionally. As shown in FIG. 7A, the adapter 221 has been inserted into the housing section 211*b*. Recesses on the adapter 221 are in alignment with the pin 236. Next, the piston and cylinder assembly is actuated to longitudinally move the thrust sleeve 234. The thrust sleeve 234 moves longitudinally upwards relative to the housing 211. Movement of the thrust sleeve 234 longitudinally compresses the main spring 235 between the flange 212 and an outer surface of the thrust sleeve 234. As a result, the main spring 235 expands radially inward toward the housing section 211*b* and the pin 236. The main spring 235 expands radially to engage the pin 236 and push the pin 236 into the extended position. The main spring 235 engages and pushes the pin 236 inwards through the port 213 formed in the housing 211. The pin 236 acts against the biasing force of the circular spring 237 and at least a portion of the pin 236 moves into the recess formed in the adapter. In the extended position shown in FIG. 7B, the pin 236 longitudinally couples the housing drive member 210 and the tool dock 220. The thrust sleeve 234 may be held in this position by the piston and cylinder assembly 231, 232 to retain the pin 236 in the extended position.

In order to decouple the drive member 210 and the tool dock 220, the piston and cylinder assembly is actuated to longitudinally lower the thrust sleeve 234. The main spring 235 returns to a relaxed position, shown in FIG. 7A. The circular spring 237 biases the pin 236 towards the retracted position to longitudinally decouple the drive member 210 and the tool dock 220. The drive member 210 is then lifted or the tool dock 220 lowered to disengage the splines, thereby rotationally decoupling the drive member 210 from the tool dock 220.

Figure 8:
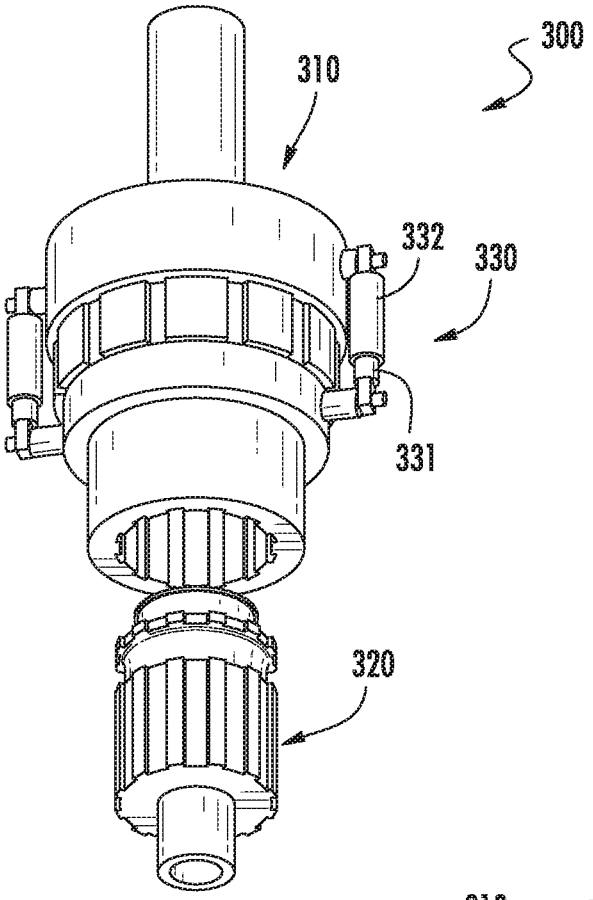
FIG. 8 illustrates an isometric view of a combined multi-coupler system according to a third embodiment.
Figure 9:
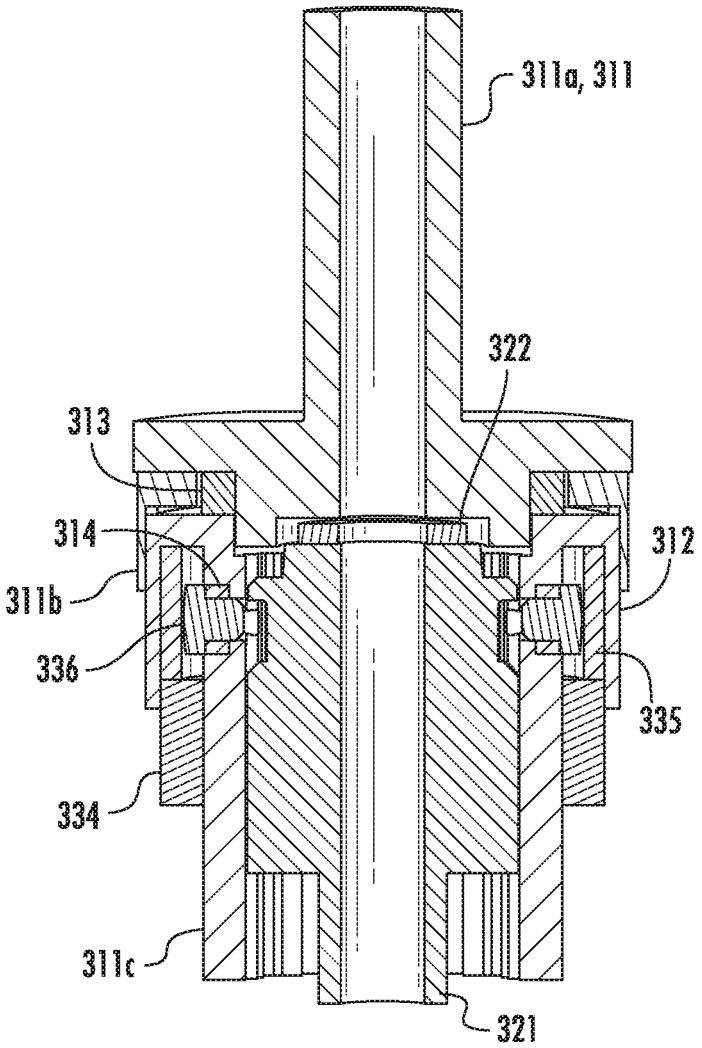
FIG. 9 illustrates a cross-sectional view of the combined multi-coupler system according to the third embodiment.

FIGS. 8 and 9 illustrate a CMC 300, according to a third embodiment. The CMC 300 includes a drive member 310, a tool dock 320, and a latch assembly 330. The drive member 310 may include a housing 311. The housing 311 may have a bore therethrough. The housing 311 may include one or more sections 311*a-c*. The housing section 311*a* may include an upper tubular portion and a lower disc portion. The housing section 311*b* may be an L-shaped flange. Splines may be formed along an inner surface of the housing section 311*b*. The splines may extend radially inward from the inner surface of the housing section 311*b*. The splines may facilitate alignment of housing section 311*c* and an adapter 321 of the tool dock 320. Corresponding splines may be formed on an outer surface of the adapter 321. The splines of the housing section 311*c* and corresponding splines of the adapter 321 may be configured to torsionally couple the housing section 311*c* and the adapter 321. The splines of the housing section 311*c* and corresponding splines of the adapter 321 may permit longitudinal movement of the adapter 321 relative to the housing section 311*c*. Splines may be formed on an outer surface of the flange 312. The splines of the flange 312 may extend radially outward. The splines of the flange 312 may facilitate alignment of housing section 311*b* and housing section 311*c*. Corresponding splines may be formed on an inner surface of housing section 311*b*. The splines of flange 312 and corresponding splines of the housing section 311*b* may be configured to torsionally couple the housing section 311*c* and the housing section 311*b*. The splines of flange 312 and corresponding splines of the housing section 311*b* may permit longitudinal movement of the housing section 311*b* relative to the flange 312 and housing section 311*c*. A recess may be formed between the housing section 311*b* and housing section 311*a*. A counter spring 313 may be disposed in the recess. The counter spring 313 may be an elastomer. The counter spring 313 may be an annular ring. The housing section 311*c* may have a bore therethrough. The housing section 311*c* may be configured to receive the tool dock 320. The housing section 311*c* may have a flange 312 formed at an upper longitudinal end thereof. The flange 312 may be integrally formed with the housing section 311*c*. A recess may be disposed between an outer surface of the housing section 311*c* and the flange 312. A port 314 may be formed through a wall of the housing section 311*c*. The port 314 may be disposed through a wall adjacent the recess. Splines may be formed along an inner surface of the housing section 311*c*. The splines may extend radially inward from the inner surface of the housing section 311*c*. The splines may assist in alignment during insertion of the tool dock 320.

The latch assembly 330 may include a piston 331 and cylinder 332 assembly, a lock member, such as thrust sleeve 334, a first biasing member, such as main spring 335, and a latch member, such as pin 336. The cylinder 332 may be connected to the outer surface of the housing section 311*a*. A fluid line may be connected to the cylinder 332 to operate the piston 331 and cylinder 332 assembly. A longitudinal end of the piston 331 may be disposed in the cylinder 332 and longitudinally movable relative thereto. A longitudinal end of the piston opposite the cylinder 332 may be connected to the thrust sleeve 334. The piston 331 and cylinder 332 assembly may be configured to longitudinally move the thrust sleeve 334 relative to the housing 311. The thrust sleeve 334 may be an annular ring. The thrust sleeve 334 may be disposed on an outer surface of the housing 311. The thrust sleeve 334 may be at least partially disposed in the recess between the flange 312 and the housing section 311*c*. The thrust sleeve 334 may be longitudinally movable relative to the housing 311 between an extended position, shown in FIG. 10A, a coupled position, shown in FIG. 10B, and a seal position, shown in FIG. 10C. The main spring 335 may be disposed in the recess between the flange 312 and the housing section 311*b*. The main spring 335 may be an annular ring. The main spring 335 may be an elastomer, such as rubber. The main spring 335 may be supported by an upper longitudinal end of the thrust sleeve 334. The main spring 335 may be longitudinally constrained in the recess between the thrust sleeve 334 and the flange 312. The thrust sleeve 334 may be configured to compress the main spring 335. The main spring 335 may be configured to engage the pin 336 during radial expansion. The thrust sleeve 334 may be configured to engage the main spring 335. The main spring 335 may be configured to radially expand within the recess when subjected to longitudinal compression. The pin 336 may be at least partially disposed in the recess between the flange 312 and the housing section 311*c*. The pin 336 may be at least partially disposed in the port 314. The pin 336 may be radially movable between a retracted position, shown in FIG. 10A, and an extended position, shown in FIGS. 10B and 10C. The thrust sleeve 334 may be configured to retain the pin 336 in the extended position. The pin 336 may have a lip configured to prevent the pin from falling into the bore of the housing section 311*c*. A circular spring 337 may be disposed around the pin 336. The circular spring 336 may be disposed between the shoulder of the pin and the outer surface of the housing section 311*c*. The circular spring 337 may be disposed in a recess of the housing section 311*c*. The circular spring 337 may be an elastomer. The circular spring 337 may bias the pin 336 towards the retracted position.

The tool dock 320 may include an adapter 321. The adapter 321 may be similar to the adapter 221. The adapter 321 may include quick connection pins disposed at a longitudinal end thereof. The quick connection pins may stab into receivers formed in an inner surface of the housing section 311*a*. The quick connection pins may be configured to transfer electricity, data, hydraulics, and/or pneumatics between the top drive and the tool. A seal 322 may be disposed at an upper longitudinal end of the adapter 321. The seal 322 may be disposed around an upper end of the bore of the adapter 321. The seal 322 may engage the housing section 311*a*. The seal 322 may prevent fluid from entering an annulus between the tool dock 320 and the housing section 311*c*. The seal 322 may be an elastomer.

Figure 10C:
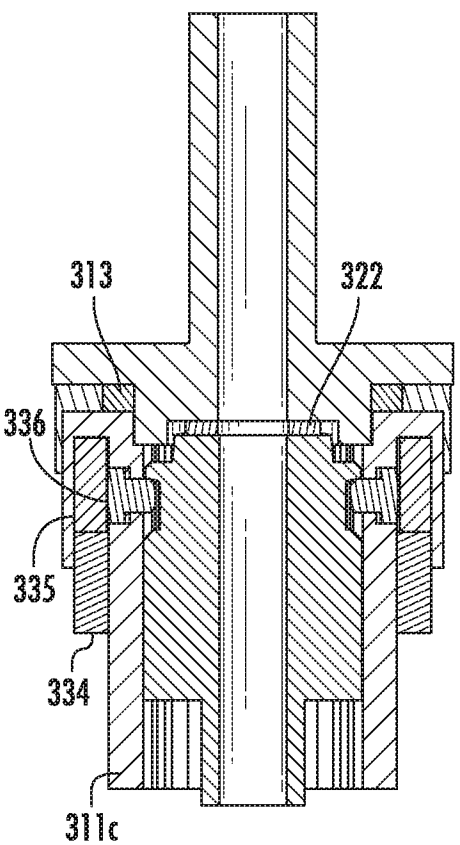
FIGS. 10A-10C illustrate operation of the combined multi-coupler system according to the third embodiment.
Figure 10B:
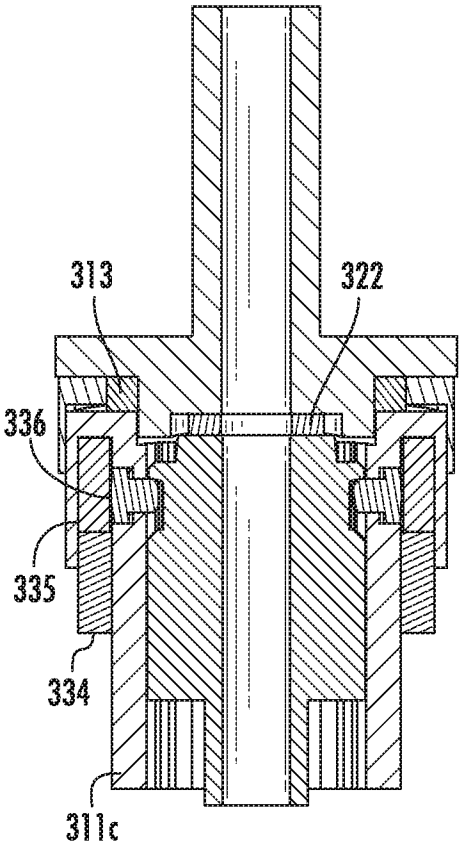
Figure 10A:
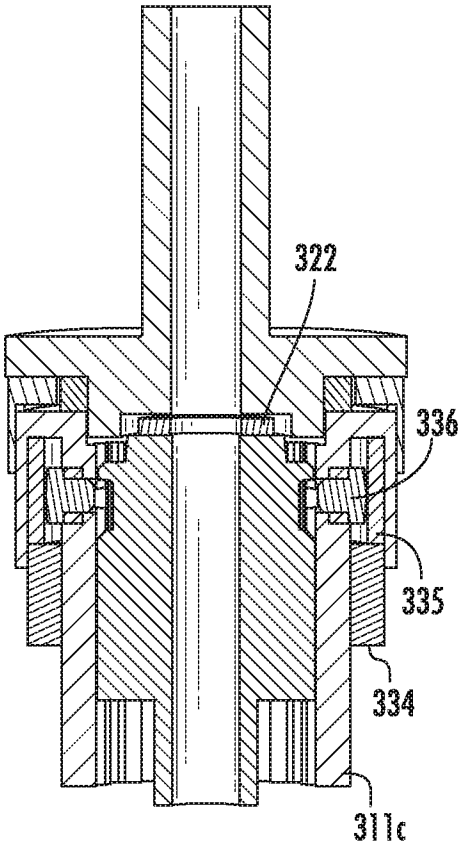

FIGS. 10A-C illustrate operation of the CMC 300. The CMC 300 is operable to torsionally and longitudinally couple the top drive to the tool. First, the adapter 321 is inserted into the bore of the housing 311. The tool dock 320 may be raised or the drive member 310 lowered to begin the process. The splines on the adapter 321 and housing section 311*c* facilitate alignment. In addition, the splines on the adapter 321 and the housing section 311*c* torsionally couple the drive member 310 and the tool dock 320. Reception of the splines of the adapter 321 within the recesses between the splines on the housing section 311*c* rotationally couples the top drive to the tool bidirectionally. As shown in FIG. 10A, the adapter 321 has been inserted into the housing section 311*c*. Recesses on the adapter 321 are in alignment with the pin 336. Next, the piston and cylinder assembly is actuated to longitudinally move the thrust sleeve 334. The thrust sleeve 334 moves longitudinally upwards relative to the housing 311. Movement of the thrust sleeve 334 longitudinally compresses the main spring 335 between the flange 312 and an outer surface of the thrust sleeve 334. As a result, the main spring 335 expands radially inward toward the housing section 311*c* and the pin 336. The main spring 335 expands radially and engages the pin 336 to move the pin 336 to the extended position. The main spring 335 engages and pushes the pin 336 inwards through the port 314 formed in the housing 311. The pin 336 acts against the biasing force of the circular spring 337 and at least a portion of the pin 336 moves into the recess formed in the adapter 321. In the extended position shown in FIG. 7B, the pin 336 longitudinally couples the housing drive member 310 and the tool dock 320.

Next, the piston and cylinder assembly is further actuated to seal a gap between the housing section 311*a* and the adapter 321. The piston and cylinder assembly longitudinally move the thrust sleeve 334. When the main spring 335 has fully expanded, the longitudinal force of the piston and cylinder assembly is transferred to the housing section 311*c*. The piston and cylinder assembly longitudinally moves the housing section 311*c* relative to the housing sections 311*a,b*. The longitudinal force is also transferred from the pin 336 to the adapter 321. As a result, the adapter 321 and housing section 311*c* longitudinally move relative to the housing sections 311*a,b*. The counter spring 313 is compressed within the recess between the housing sections 311*a,c*. Longitudinal movement of the adapter 321 and housing section 311*c* causes the seal 322 to engage the housing section 311*a*. The engaged seal 322 prevents fluid passing through the bore of the housing section 311*a* from entering the annulus between the housing section 311*c* and the adapter 321. The thrust sleeve 334 may be held in this position by the piston and cylinder assembly 331, 332 to retain the pin 336 in the extended position.

In order to decouple the drive member 310 and the tool dock 320, the piston and cylinder assembly is actuated to longitudinally lower the thrust sleeve 334. The counter spring 313 biases the housing section 311*c* away from the housing section 311*a*. The seal 322 disengages from the housing section 311*a*. Next, the thrust sleeve 334 moves longitudinally relative to the housing section 311*c*. The main spring 335 returns to a relaxed position, shown in FIG. 10A. The circular spring 337 biases the pin 336 towards the retracted position, shown in FIG. 10A, to longitudinally decouple the drive member 310 and the tool dock 320. The drive member 310 is then lifted or the tool dock 320 lowered to disengage the splines, thereby rotationally decoupling the drive member 310 from the tool dock 320.

Figure 12:
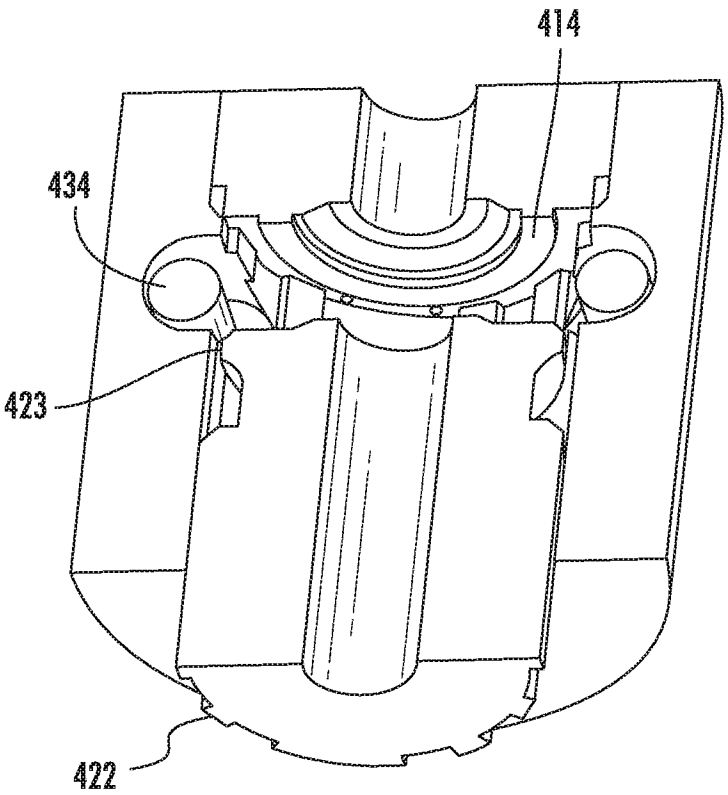
FIG. 12 illustrates a cross-sectional view of the combined multi-coupler system according to the fourth embodiment.
Figure 11:
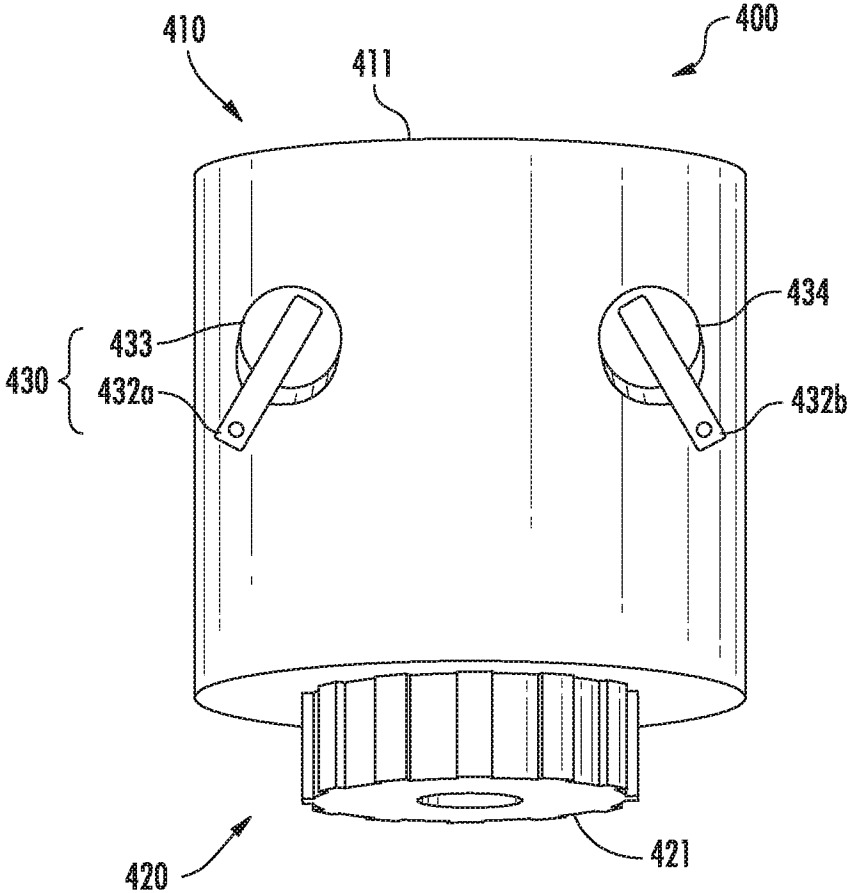
FIG. 11 illustrates an isometric view of the combined multi-coupler system according to a fourth embodiment.

FIGS. 11 and 12 illustrate a CMC system 400, according to a fourth embodiment. The CMC 400 includes a drive member 410 and a tool dock 420. The drive member 410 includes a housing 411. The housing 411 may be tubular having a bore therethrough. The housing 411 may be configured to receive an adapter 421 of the tool dock 420. The housing 411 may have splines formed longitudinally along an inner surface thereof. The housing 411 may have a window formed through an outer wall thereof. The window may be circular. The window may extend at least partially through the bore of the housing 411. The window may be formed at least partially off-center from a radial axis of the housing 411. A second window may be formed on an opposite side and at the same height through the housing 411 as the window. A seal 414 may be disposed in the bore of the housing 411. The seal 414 may be an elastomer. The seal 414 may be configured to prevent fluid entering an annulus between the housing 411 and the adapter 421.

The tool dock 420 may include an adapter 421. The adapter 421 may be similar to the adapter 221. The adapter 421 may include quick connection pins disposed at a longitudinal end thereof. The quick connection pins may stab into receivers formed in an inner surface of the housing section 411. The quick connection pins may be configured to transfer electricity, data, hydraulics, and/or pneumatics between the top drive and the tool. The adapter 421 may be tubular having a bore therethrough. The adapter 421 may have splines 422 formed on an outer surface thereof. A lip 423 may be formed at an upper longitudinal end of the adapter 421. A recess 424 may be formed between the lip 423 and the splines 422.

Figure 14:
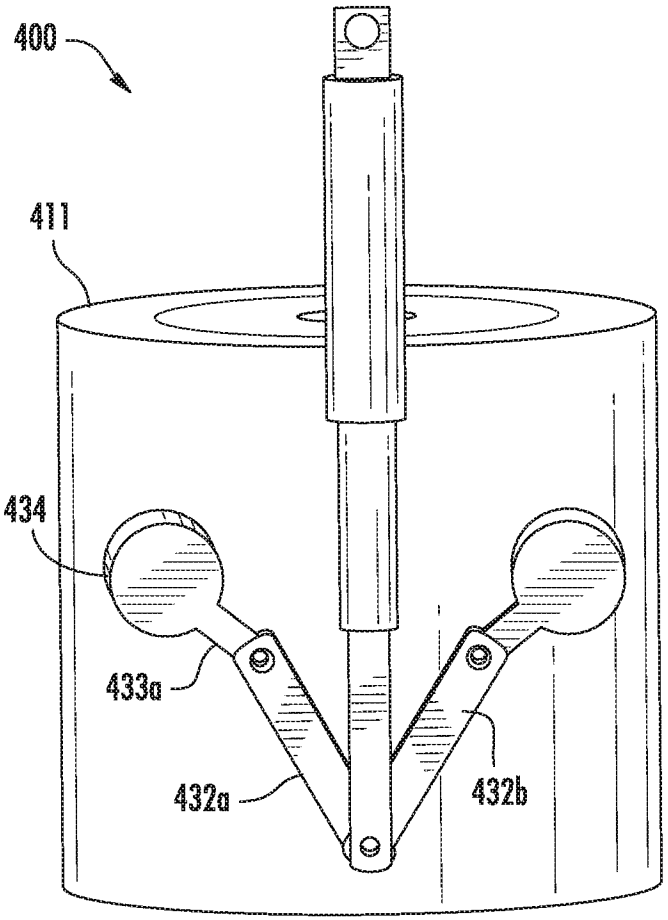
FIGS. 13 and 14 illustrate operation of an actuator assembly of the fourth embodiment.
Figure 13:
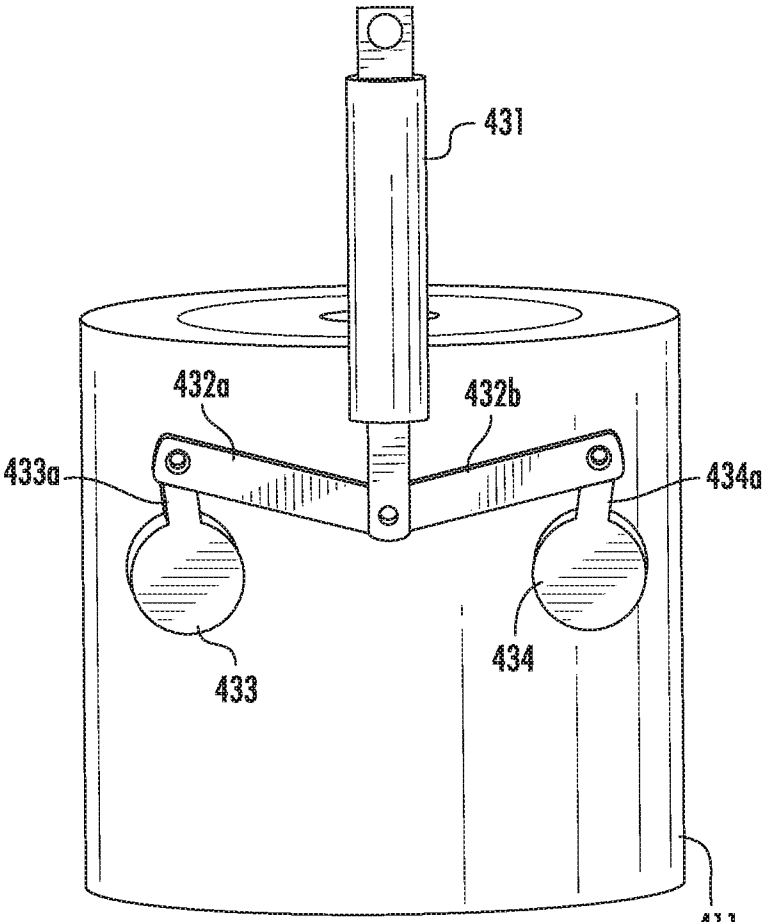

FIGS. 13 and 14 illustrate the latch assembly 430 of the CMC 400. The latch assembly 430 may include an actuator, such as piston and cylinder assembly 431, levers 432*a,b*, and crankshafts 433, 434. The piston and cylinder assembly 431 may be longitudinally coupled to the housing 411 at an upper longitudinal end. The piston may be coupled to the levers 432*a,b* an opposite end. The piston and cylinder assembly 431 may be configured to actuate the levers 432*a,b*. The piston and cylinder assembly 431 may be configured to turn the crankshafts 433, 434 between a locked position, shown in FIG. 13, and an unlocked position, shown in FIG. 14. The lever 432*a* may be a straight metal arm. The lever 432*a* may be coupled to an arm 433*a* of the crankshaft 433. The lever 432*b* may be coupled to an arm 434*a* of the crankshaft 434. The crankshafts 433, 434 may be cylindrical in shape. The windows may be configured to receive the crankshafts 433, 434. The crankshafts 433, 434 may include eccentric middle portions 433*b*, 434*b* (FIG. 15A) having a smaller cross-sectional area than the remainder of the crankshafts 433, 434. The middle portions 433*b*, 434*b* may be disposed off-center from a longitudinal axis of the crankshafts 433, 434.

Figure 15B:
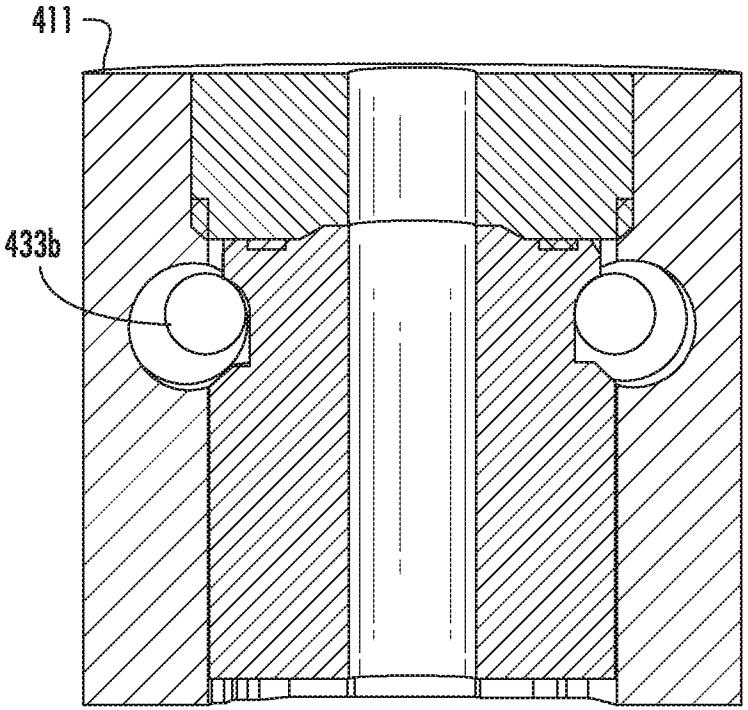
FIGS. 15A and 15B illustrate operation of the combined multi-coupler system according to the fourth embodiment.
Figure 15A:
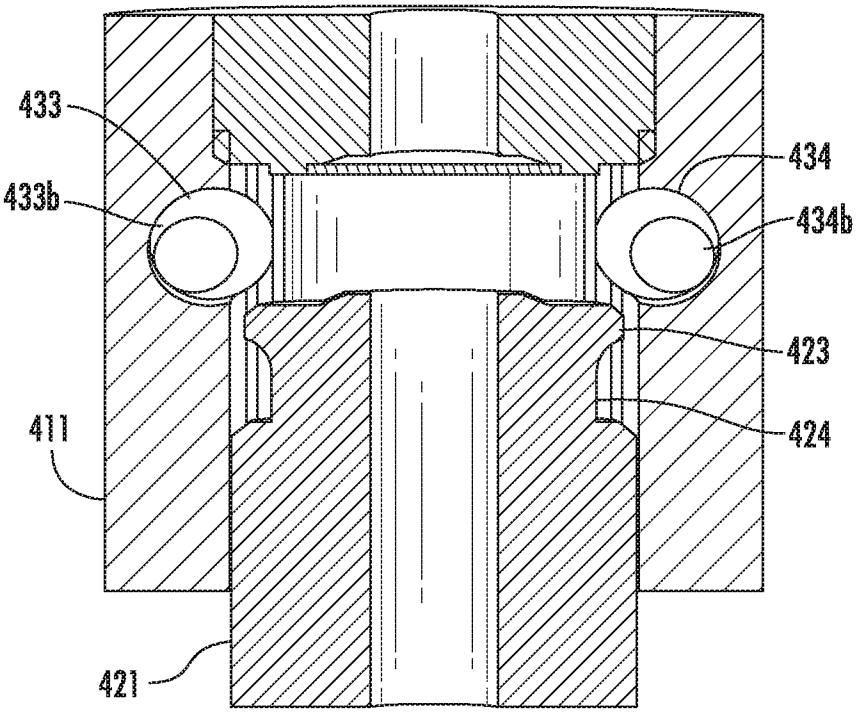

FIGS. 15A and 15B illustrate operation of the CMC 400. The CMC 400 is operable to torsionally and longitudinally couple the top drive to the tool. First, the adapter 421 is inserted into the bore of the housing 411. The tool dock 420 may be raised or the drive member 410 lowered to begin the process. The splines 422 on the adapter 421 and housing 411 facilitate alignment. In addition, the splines 422 on the adapter 421 and the housing 411 torsionally couple the drive member 410 and the tool dock 420. Reception of the splines 422 of the adapter 421 within the recesses between the splines on the housing 411 rotationally couples the top drive to the tool bidirectionally. As shown in FIG. 15A, the adapter 421 has been inserted into the housing 411. The adapter 421 is inserted into the housing 411 until the recess 424 is positioned adjacent the crankshafts 433, 434. The seal 414 engages an upper longitudinal end of the adapter 421. Next, the piston and cylinder assembly 431 actuates the levers 432*a,b*. Actuation of the levers 432*a,b* rotates the crankshafts 433, 434. The rotation of the crankshafts 433, 434 moves the middle portions 433*b*, 434*b* into the recess 424, as shown in FIG. 15B. The eccentric middle portions 433*b*, 434*b* engage the lip 423 to longitudinally couple the adapter 421 and the housing 411.

In order to decouple the drive member 410 and the tool dock 420, the piston and cylinder assembly 431 is actuated to shift the levers 432*a,b* back to the position shown in FIG. 14. The crankshafts 433, 434 rotate within the windows. The middle portions 433*b*, 434*b* rotate and disengage from the lip 423. The middle portions 433*b*, 434*b* continue to rotate out of recess 424 to longitudinally decouple the adapter 421 and the housing 411. The drive member 410 is then lifted or the tool dock 420 lowered to disengage the splines, thereby rotationally decoupling the drive member 410 from the tool dock 420.

Figure 16:
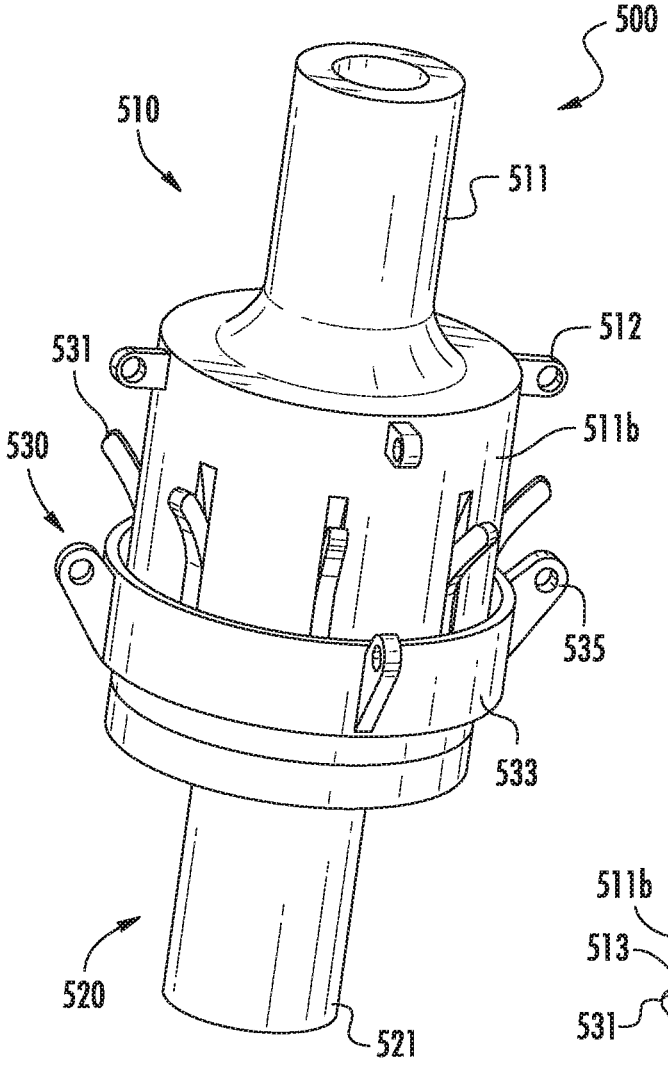
FIG. 16 illustrates an isometric view of the combined multi-coupler system according to a fifth embodiment.
Figure 17:
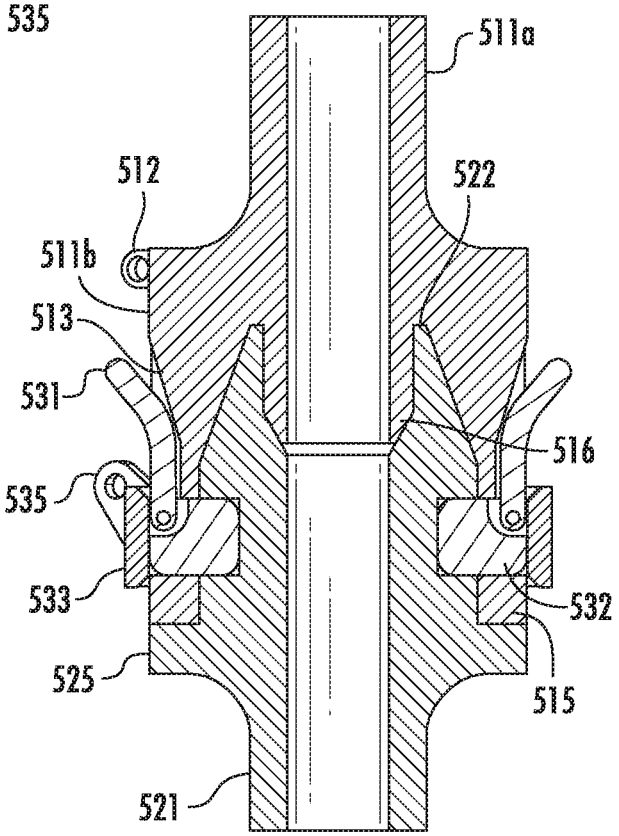
FIG. 17 illustrates a cross-sectional view of the combined multi-coupler system according to the fifth embodiment.

FIGS. 16 and 17 illustrate a CMC 500, according to a fifth embodiment. The CMC 500 includes a drive member 510, tool dock 520, and latch assembly 530. The drive member 510 may be integrally formed with the top drive. The drive member 510 may include a housing 511. The housing 511 may be bell-shaped having an upper tubular section 511*a* and a lower bell section 511*b*. The housing sections 511*a,b* may have a bore therethrough. An upper end of the housing section 511*a* may be integrally formed with the top drive. The bell section 511*b* may have connections 512 formed at an upper end thereof. The connections 512 may be hooks configured to connect to an actuator. The actuator may be a piston and cylinder assembly. The bell section 511*b* may have a groove 513 formed along an outer surface thereof. The groove 513 may be longitudinally aligned. The groove 513 may have a tapered surface. A hole may be formed through the bell section 511*b* at a lower end of the groove 513. The bell section 511*b* may have a shoulder 515 formed at a lower end thereof. An inner recess may be formed through a lower end of the bell section 511*b*, adjacent the shoulder 515. The inner recess may extend longitudinally through the bell section 511*b* towards the tubular section 511*a* of the housing 511. The inner recess may be configured to receive an adapter 521 of the tool dock 520. A cone 516 may be formed in the inner recess of the bell section 511*b*. The cone 516 may extend longitudinally through the inner recess towards a lower end of the bell housing 511*b*. The bore of the housing 511 may extend through the cone 516. The cone 516 may have a lip formed at a lower end thereof.

The tool dock 520 may include the adapter 521. The adapter 521 may be integrally formed with the tool dock 520. The adapter 521 may have a bore therethrough. The adapter 521 may have an upper pin section and a lower tubular section. The pin section may have a cone 522 formed at an upper end thereof. The cone 522 may be configured to receive the cone 516 of the bell section 511*b*. A seat may be formed along an inner surface of the cone 522. The seat may be configured to receive the lip of the cone 516. The inner recess of the bell section 511*b* may be configured to receive the pin section. A window may be formed in an outer wall of the cone 522. The window may be aligned with the hole of the bell section 511*b*. A shoulder 525 may be formed at a lower end of the pin section. The shoulder 525 may be configured to engage the shoulder 515 of the bell section 511*b*.

The latch assembly 530 may include a lever 531, a latch member, such as block 532, and a lock member, such as locking ring 533. The lever 531 may be disposed in the groove 513 of the bell section 511*b*. The lever 531 may be substantially L-shaped. The lever 531 may be pivotally movable relative to the bell section 511*b*. A pin may couple a lower end of the lever 531 to the block 532. The block 532 may be disposed in the hole of the bell section 511*b*. The window may be configured to receive the block 532 in a locked position of the latch assembly 530. The locking ring 533 may be an annular ring. The locking ring 533 may be disposed on an outer surface of the bell section 511*b*. The locking ring 533 may have a hook 535 formed on an outer surface thereof. Hook 535 may be configured to longitudinally couple the locking ring 533 to an actuator. The locking ring 533 may be longitudinally movable relative to the bell section 511*b*.

The CMC 500 is operable to longitudinally and torsionally couple the top drive to the tool. The locking ring 533 is in a first position, engaging an upper longitudinal end of the lever 531. The force applied to the lever 531 by the locking ring 533 retains the block 532 in a retracted position. The block 532 may be partially disposed in the hole of the bell section 511*b* in the retracted position. First, the adapter 521 is stabbed into the inner recess of the bell section 511*b*. The tool dock 520 may be raised into the drive member 510 or the drive member 510 lowered onto the tool dock 520 to begin the stabbing process. The cone 516 of the bell section 511*b* is stabbed into the cone 522 of the pin section. The lip of the cone 516 engages and seals against the seat of the cone 522. The hole of the bell section 511*b* moves into alignment with the window of the cone 522. Once the pin section has been stabbed into the inner recess of the bell section 511*b*, the actuators longitudinally move the locking ring 533 relative to the housing 511 and tool dock 520. The locking ring 533 is lowered around the outside of the bell section 511*b*. As the locking ring 533 moves longitudinally towards the tool dock 520, the locking ring 533 engages a lower end of the lever 531. The lever 531 pivots relative to the housing 511, moving the block 532 into the locked position, disposed in the window of the cone 522. In the locked position, the block 532 serves to longitudinally and torsionally couple the tool dock 520 to the drive member 510. Reception of the block 532 within the window of the cone 522 rotationally couples the top drive to the tool bidirectionally. The locking ring 533 retains the block 532 in the locked position.

In order to unlock the tool dock 520 and the drive member 510, the actuators move the locking ring 533 longitudinally away from the tool dock 520. The locking ring 533 engages the upper end of the lever 531, causing the lever 531 to pivot relative to the housing 511. The pivotal motion of the lever 531 causes the block 532 to move radially out of the window to the retracted position.

Figure 18:
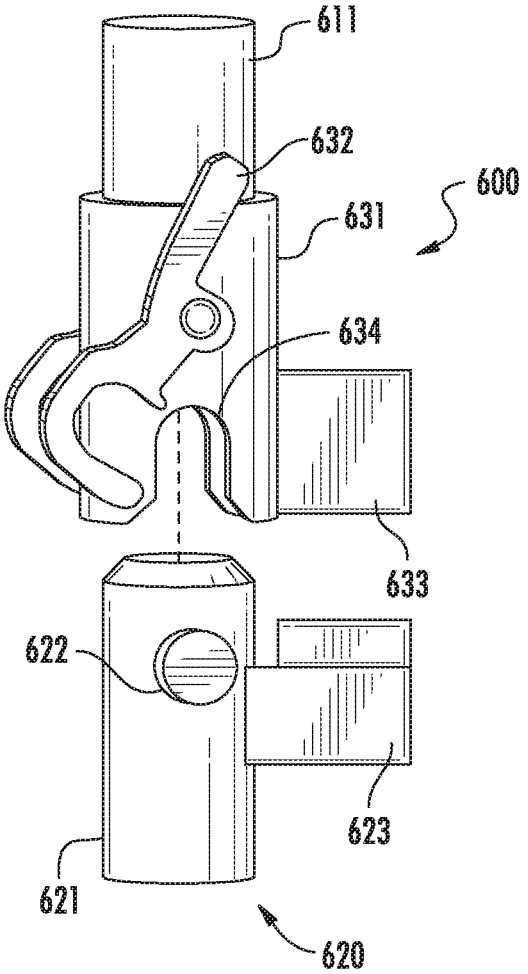
FIGS. 18 and 19 illustrate operation of the combined multi-coupler system according to a sixth embodiment.
Figure 19:
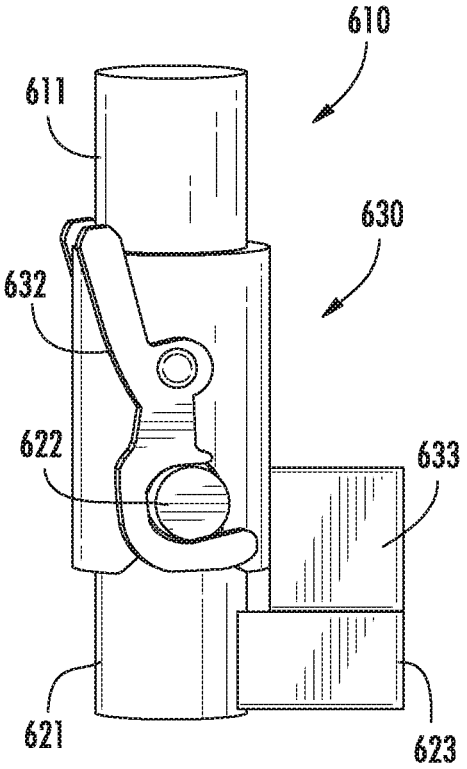

FIGS. 18 and 19 illustrate a CMC 600, according to a sixth embodiment. The CMC 600 includes a drive member 610, a tool dock 620, and a latch assembly 630. The drive member 610 may be integrally formed with the top drive. Alternatively, the drive member 610 may have a coupling, such as a threaded coupling, formed at an upper longitudinal end thereof for connection to the top drive. The drive member 610 may include a housing 611. The housing 611 may be tubular having a bore therethrough.

The tool dock 620 may be integrally formed with the tool. Alternatively, the tool dock may have a coupling at a lower longitudinal end thereof for connection to the tool. The tool dock 620 may include the adapter 621. The adapter 621 may be tubular having a bore therethrough. The adapter 621 may have a protrusion 622 formed on an outer surface thereof. The protrusion 622 may have a cylindrical shape. The protrusion 622 may be configured to receive an arm of a lever. A second protrusion may be formed on the outer surface of the adapter 621. The second protrusion may be formed 180 degrees apart from the protrusion 622. A signal connector 623 may be formed on the outer surface of the adapter 621. The signal connector 623 may be configured to receive and transmit power, electrical, data, hydraulic, pneumatic and/or other connections between the top drive and the tool.

The latch assembly 630 may include a sleeve 631, a latch member, such as lever 632, an actuator, and a signal pin 633. The sleeve 631 may be tubular having a bore therethrough. The sleeve 631 may be disposed on an outer surface of the housing 611. The sleeve 631 may at least partially extend past a lower longitudinal end of the housing 611. The sleeve 631 may have a notch 634 formed at a lower end thereof. The notch 634 may be configured to receive the protrusion 622. A second notch may be formed at a lower end of the sleeve 631 and may be configured to receive the second protrusion. The lever 632 may be pivotally coupled by the sleeve. The lever 632 may be pivotally movable relative to the sleeve 631 between an unlocked position, shown in FIG. 18, and a locked position, shown in FIG. 19. The actuator (not shown) may be a piston and cylinder assembly. The actuator may be coupled to the lever 632. The actuator may be operable to actuate the lever 632 between the positions. The signal pin 633 may be disposed on an outer surface of the sleeve 631. The signal pin 633 may be configured to connect to the signal connector 623.

In operation, the CMC 600 torsionally and longitudinally couples the tool dock and the top drive. The adapter 621 is inserted into the bore of the sleeve 631. The tool dock 620 may be raised or the drive member 610 lowered to begin the process. The protrusion 622 is aligned and enters the notch 634. The protrusion 622 continues moving through the notch 634 until reaching an upper longitudinal end of the notch 634. The protrusion 622 and notch 634 provide torsional coupling between the drive member 610 and the tool dock 620. Reception of the protrusion 622 within the notch 634 rotationally couples the top drive to the tool bidirectionally. The signal pin 633 and signal connector 623 engage and provide power, electrical, data, hydraulic, pneumatic and/or other connections between the drive member 610 and the tool dock 620. Next, the actuator is operated to shift the lever 632 to the locked position, shown in FIG. 19. The lever 632 pivots relative to the sleeve 631. An arm of the lever 632 hooks underneath the protrusion 622 to support the adapter 621. The lever 632 and protrusion 622 longitudinally couple the drive member 610 and the tool dock 620.

In order to decouple the drive member 610 and the tool dock 620, the actuator returns the lever 632 to the unlocked position, shown in FIG. 18. The drive member 610 is then lifted or the tool dock 620 lowered to disengage the protrusion 622 from the notch 634, thereby torsionally decoupling the tool dock 620 from the drive member 610.

In one embodiment, a coupling system for a top drive includes a housing having a bore therethrough, a latch member at least partially disposed within the housing and radially movable between an extended position and a retracted position, wherein the latch member is configured to longitudinally couple the housing to a tool, and a lock member longitudinally movable relative to the housing and configured to move the latch member between the extended and the retracted positions.

In one or more of the embodiments described herein, the lock member is at least partially disposed within the housing.

In one or more of the embodiments described herein, the coupling system includes an actuator configured to longitudinally move the lock member.

In one or more of the embodiments described herein, the actuator is disposed on an outer surface of the housing.

In one or more of the embodiments described herein, the actuator is a piston and cylinder assembly.

In one or more of the embodiments described herein, the housing has a port formed through a wall thereof.

In one or more of the embodiments described herein, the coupling system includes a tool dock.

In one or more of the embodiments described herein, the tool dock includes an adapter having a bore therethrough and longitudinally movable relative to the housing.

In one or more of the embodiments described herein, the adapter further includes quick connection pins located at a longitudinal end thereof.

In one or more of the embodiments described herein, the housing is configured to receive the adapter.

In one or more of the embodiments described herein, the latch member is at least partially disposed in a recess of the adapter in the extended position.

In one or more of the embodiments described herein, the lock member engages the latch member to retain the latch member in the extended position.

In another embodiment, a coupling system for coupling a top drive to a tool includes a housing having a bore therethrough, a sleeve disposed on an outer surface of the housing, a latch member disposed on an outer surface of the sleeve, wherein the latch member is configured to longitudinally couple the housing to the tool, and a tool dock integrally formed with the tool and configured to receive the latch member.

In one or more of the embodiments described herein, the coupling system includes a signal pin disposed on an outer surface of the sleeve.

In one or more of the embodiments described herein, the coupling system includes a signal connector disposed on an outer surface of the tool dock, wherein the signal connector is configured to receive the signal pin.

In one or more of the embodiments described herein, the coupling system includes a protrusion formed on an outer surface of the housing and configured to receive the latch member.

In one or more of the embodiments described herein, the coupling system includes a notch formed at a longitudinal end of the sleeve and configured to receive the protrusion.

In one or more of the embodiments described herein, the latch member is a lever pivotally coupled to the sleeve.

In another embodiment, a coupling system for coupling a top drive includes a housing having a bore therethrough, a latch member at least partially disposed through a wall of the housing and rotatable relative to the housing, wherein the latch member is configured to longitudinally couple the housing to a tool, and an actuator disposed on an outer surface of the housing and configured to rotate the latch member.

In one or more of the embodiments described herein, the latch member comprises at least one crankshaft including an eccentric middle portion.

In one or more of the embodiments described herein, the coupling system includes a linkage coupling the actuator to the at least one crankshaft.

In one or more of the embodiments described herein, the actuator is a piston and cylinder assembly.

In one or more of the embodiments described herein, a coupling system for a top drive and a tool includes a housing of the top drive having a bore therethrough, an adapter of the tool, a latch member at least partially disposed within the housing and radially movable between an extended position and a retracted position, wherein the latch member is configured to longitudinally couple the housing to the adapter, a lock member at least partially disposed within the housing and longitudinally movable relative to the housing, wherein the lock member is configured to move the latch member between the extended and the retracted positions, and an actuator configured to longitudinally move the lock member.

In one or more of the embodiments described herein, the lock member is configured to retain the latch member in the extended position.

In one or more of the embodiments described herein, the adapter includes a bore configured to receive the housing.

In one or more of the embodiments described herein, wherein the lock member includes a tapered surface configured to engage the latch member.

In one or more of the embodiments described herein, wherein the actuator is a piston and cylinder assembly.

In one or more of the embodiments described herein, wherein the housing has a port formed therethrough.

In one or more of the embodiments described herein, wherein the actuator is at least partially disposed through the port.

In one or more of the embodiments described herein, the adapter further includes a recess disposed therein.

In one or more of the embodiments described herein, the adapter further comprising quick connection pins located at a longitudinal end thereof, wherein the quick connection pins are configured to transfer at least one of power, data, electronics, hydraulics, and pneumatics.

In one or more of the embodiments described herein, further including a biasing member, the biasing member configured to bias the latch member towards the retracted position.

In one or more of the embodiments described herein, wherein the latch member is at least partially disposed in the recess in the extended position.

In one or more of the embodiments described herein, wherein the lock member engages the latch member to retain the latch member in the extended position.

In one or more of the embodiments described herein, wherein the bore of the housing is configured to receive the adapter.

In one or more of the embodiments described herein, a method of coupling a top drive and a tool includes moving a top drive adjacent a tool, the top drive including a housing, a lock member at least partially disposed within the housing, and a latch member at least partially disposed within the housing and the tool including an adapter. The method further includes inserting the adapter into the housing, shifting the lock member longitudinally relative to the housing, and moving the latch member radially between an extended position and a retracted position to couple the top drive and the tool.

In one or more of the embodiments described herein, the method includes retaining the latch member in the extended position using the lock member.

In one or more of the embodiments described herein, the method includes biasing the latch member towards the retracted position.

In one or more of the embodiments described herein, the method includes engaging a biasing member using the lock member.

In one or more of the embodiments described herein, the method includes expanding the biasing member radially to move the latch member to the extended position.

In one or more of the embodiments described herein, the method includes transferring at least one of power, data, electronics, hydraulics, and pneumatics between the adapter and the housing using quick connection pins.

In one or more of the embodiments described herein, the method includes engaging splines of the housing with splines of the adapter, thereby transferring torque between the housing and the adapter.

While the foregoing is directed to embodiments of the present invention, other and further embodiments of the invention may be devised without departing from the basic scope thereof, and the scope thereof is determined by the claims that follow.

The invention claimed is:

1. A coupling system for a top drive and a tool, comprising:

a housing of the top drive having a bore therethrough;

an adapter of the tool, the adapter having a recess;

a latch member at least partially disposed within the housing and radially movable between an extended position and a retracted position, wherein the latch member, in the extended position, is at least partially disposed in the recess to longitudinally couple the housing to the adapter; and a lock member at least partially disposed within the housing and longitudinally movable relative to the housing, wherein the lock member is configured to move the latch member between the extended and the retracted positions.

2. The coupling system of claim 1, wherein the lock member is configured to retain the latch member in the extended position.

3. The coupling system of claim 1, wherein the adapter includes a bore configured to receive the housing.

4. The coupling system of claim 1, wherein the lock member includes a tapered surface configured to engage the latch member.

5. The coupling system of claim 1, further comprising an actuator configured to longitudinally move the lock member.

6. The coupling system of claim 1, wherein the housing has a port formed therethrough.

7. The coupling system of claim 6, wherein an actuator is at least partially disposed through the port.

8. The coupling system of claim 6, wherein the latch member is at least partially disposed in the port.

9. The coupling system of claim 1, the adapter further comprising quick connection pins located at a longitudinal end thereof, wherein the quick connection pins are configured to transfer at least one of power, data, electronics, hydraulics, and pneumatics.

10. The coupling system of claim 1, further including a biasing member, the biasing member configured to bias the latch member towards the retracted position.

11. A method of coupling a top drive and a tool, comprising:

moving a top drive adjacent to a tool, the top drive including a housing, a lock member at least partially disposed within the housing, and a latch member at least partially disposed within the housing;

engaging the housing to an adapter of the tool;

shifting the lock member longitudinally relative to the housing; and extending the latch member radially into a recess of the adapter, thereby coupling the tool to the top drive.

12. The method of claim 11, further comprising retaining the latch member in the extended position using the lock member.

13. The method of claim 11, further comprising biasing the latch member towards the retracted position.

14. The method of claim 11, further comprising engaging a biasing member using the lock member.

15. The method of claim 14, further comprising expanding the biasing member radially to move the latch member to the extended position.

16. The method of claim 11, further comprising transferring at least one of power, data, electronics, hydraulics, and pneumatics between the adapter and the housing using quick connection pins.

17. The method of claim 11, further comprising engaging splines of the housing with splines of the adapter, thereby transferring torque between the housing and the adapter.

18. The method of claim 11, wherein the latch member is at least partially disposed within a port of the housing.

19. A coupling system for a top drive and a tool, comprising:

a housing of the top drive having a bore therethrough;

an adapter of the tool;

a latch member at least partially disposed in a port of the housing and radially movable between an extended position and a retracted position, wherein the latch member is configured to longitudinally couple the housing to the adapter;

a lock member at least partially disposed within the housing and longitudinally movable relative to the housing, wherein the lock member is configured to move the latch member between the extended and the retracted positions;

a plurality of drive keys formed on the housing; and a plurality of adapter keys formed on the adapter, wherein the plurality of drive keys engage the plurality of adapter keys for transferring torque from the housing to the adapter.

20. The coupling system of claim 19, wherein the adapter includes a bore configured to receive the housing.

21. The coupling system of claim 20, wherein the lock member includes a tapered surface configured to engage the latch member.

22. The coupling system of claim 21, further comprising an actuator configured to longitudinally move the lock member.

23. The coupling system of claim 22, wherein the latch member in the extended position, is at least partially disposed in a recess to longitudinally couple the housing to the adapter.

24. The coupling system of claim 23, further including a biasing member, the biasing member configured to bias the latch member towards the retracted position.

25. The coupling system of claim 24, wherein the adapter further comprises quick connection pins located at a longitudinal end thereof, wherein the quick connection pins are configured to transfer at least one of power, data, electronics, hydraulics, and pneumatics.

* * * * *